US007654803B2

(12) United States Patent
Harada et al.

(10) Patent No.: US 7,654,803 B2
(45) Date of Patent: Feb. 2, 2010

(54) TUBE PUMP AND LIQUID EJECTION APPARATUS

(75) Inventors: Shuhei Harada, Nagano-ken (JP); Shozo Kuwada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 436 days.

(21) Appl. No.: 11/109,731

(22) Filed: Apr. 20, 2005

(65) Prior Publication Data

US 2005/0285892 A1 Dec. 29, 2005

Related U.S. Application Data

(63) Continuation-in-part of application No. 10/817,429, filed on Apr. 5, 2004, now Pat. No. 7,241,119.

(30) Foreign Application Priority Data

Apr. 4, 2003 (JP) ..... 2003-101868
Apr. 22, 2004 (JP) ..... 2004-127103

(51) Int. Cl.
*F04B 43/12* (2006.01)
*F04B 45/06* (2006.01)

(52) U.S. Cl. ..... 417/477.11; 417/477.9; 417/477.12

(58) Field of Classification Search ..... 417/476, 417/477.1, 477.9, 477.11, 477.12
See application file for complete search history.

(56) References Cited

U.S. PATENT DOCUMENTS 2,102,523 A 12/1937 Ferrara et al.
2,899,905 A * 8/1959 Becher ..... 417/475
2,987,004 A * 6/1961 Murray ..... 417/477.12
2,988,001 A 6/1961 D'Arcey et al.
4,288,205 A * 9/1981 Henk ..... 417/477.3
4,576,556 A * 3/1986 Thompson ..... 417/477.12
5,340,290 A 8/1994 Clemens
5,897,300 A * 4/1999 Luedtke ..... 417/477.9
6,494,693 B1 * 12/2002 Sunden ..... 417/477.7
7,241,119 B2 * 7/2007 Harada ..... 417/477.11
2004/0141863 A1 7/2004 Harada et al.

FOREIGN PATENT DOCUMENTS

JP 7-253082 A 10/1995
JP 11-013648 A 1/1999
JP 2001-082353 A 3/2001
JP 2001-301195 A 10/2001
JP 2004-137940 A 5/2004

* cited by examiner

*Primary Examiner*—Devon C Kramer
*Assistant Examiner*—Patrick Hamo
(74) *Attorney, Agent, or Firm*—Sughrue Mion, PLLC

(57) ABSTRACT

A flexible tube has a first portion and a second portion located close to each other in the vicinity of an opening of an accommodating case. A pressing member moves from the first portion to the second portion along the tube while pressing a portion of the tube. An assistant member is provided in the vicinity of the opening of the case. The assistant member has an assistant surface. When the pressing member passes the vicinity of the opening of the case, the assistant member transfers the pressing member from the second portion to the first portion via the assistant surface. This structure ensures a silent operation of the tube pump.

9 Claims, 13 Drawing Sheets

TUBE PUMP AND LIQUID EJECTION APPARATUS

CROSS-REFERENCE TO RELATED APPLICATIONS

This application is a continuation-in-part application of U.S. Ser. No. 10/817,429 U.S. Pat. No. 7,241,119, filed on Apr. 5, 2004, entitled "TUBE PUMP AND LIQUID INJECTION APPARATUS."

BACKGROUND OF THE INVENTION

The present invention relates to tube pumps and liquid ejection apparatuses, and, more particularly, to tube pumps and liquid ejection apparatuses that operate silently.

Conventionally, a tube pump drawing fluid from one end and discharging it from another by generating negative pressure is known. Since this type of pump is configured simple and compact, the pump is used in different types of apparatuses that involve the use of fluid.

For example, the tube pump is used in an inkjet recording apparatus (a liquid ejection apparatus), which discharges (ejects) ink (liquefied fluid) to a recording sheet through a nozzle of a recording head, forming an image on the sheet. The tube pump draws ink from the nozzle when the recording head is cleaned for ensuring a smooth operation of the recording head (for example, Japanese Laid-Open Patent Publications No. 2001-301195 and No. 7-253082).

As illustrated in FIGS. 27 and 28, in the tube pumps described in the aforementioned documents, a flexible tube 1 is accommodated in a cylindrical case 2. A roller 3 operates to press and squeeze the tube 1 against an inner wall 2*a* of the case 2. The position at which the tube 1 is pressed by the roller 3 constantly shifts from an upstream position to a downstream position of the tube 1. The tube pump thus generates negative pressure at an upstream section of the tube 1. The ink is thus drawn from the upstream section of the tube 1 and is discharged from the downstream side of the tube 1.

However, these tube pumps (Japanese Laid-Open Patent Publication No. 2001-301195 corresponds to FIG. 27 and Japanese Laid-Open Patent Publication No. 7-253082 corresponds to FIG. 28) include overlapped portions 1*a*, 1*b*, at which a certain portion of the tube 1 crosses and overlaps a different portion of the tube 1 inside or outside the case 2. This arrangement enlarges the space occupied by the tube 1, thus preventing the tube pumps from being formed compact.

Further, in some color inkjet recording apparatuses, two flexible tubes 1, one for color ink and the other for black, are provided integrally with each other. In this case, the tube pump has four overlapped portions 1*a*, 1*b* of the tube 1. The space occupied by the overlapped portions 1*a*, 1*b* is thus further enlarged, worsening the aforementioned problem.

To solve the problem, an opening 2*b* extends through a portion of the inner wall 2*a* of the case 2, as shown in FIG. 29. The tube 1 is passed through the opening 2*b* without forming overlapped portions. The ends of the tube 1 are then separated from each other without interfering with each other.

However, in this configuration, at a position corresponding to the opening 2*b* of the case 2 (as indicated by the broken line in FIG. 29), the roller 3 quickly moves from the downstream portion to the upstream portion along the outer circumferential surface of the tube 1. At this stage, since the two portions have greatly different surface conditions, a noise may be caused due to an impact between the roller 3 and the tube 1. Further, when the roller 3 proceeds from the downstream portion to the upstream portion, squeezing of the tube 1 by the roller 3 may become insufficient. If this is the case, the interior of the tube 1 may instantly become continuous, releasing the negative pressure. This problem equally occurs in the tube pump of Japanese Laid-Open Patent Publication No. 7-253082 (FIG. 28).

SUMMARY OF THE INVENTION

Accordingly, it is an objective of the present invention to provide an improved tube pump and liquid ejection apparatus that operate without producing noise.

To achieve the foregoing and other objectives and in accordance with the purpose of the present invention, the invention provides a tube pump comprising a flexible tube in which a fluid passage is formed, an accommodating case for accommodating the flexible tube, a pressing member revolving in the accommodating case, and an assistant member formed in the vicinity of the opening of the accommodating case. The tube extends along an inner wall of the case. The inner wall has an opening, and the tube extends to the exterior of the case through the opening. The tube has a first portion and a second portion, which are located close to each other in the vicinity of the opening. The pressing member moves from the first portion to the second portion along the flexible tube while pressing and squeezing a portion of the tube against the inner wall of the case. This enables a fluid to flow from the first portion to the second portion in the fluid passage. The assistant member has an assistant surface. When the pressing member passes the vicinity of the opening of the case, the assistant member transfers the pressing member from the second portion to the first portion via the assistant surface.

BRIEF DESCRIPTION OF THE DRAWINGS

The characteristics of the present invention believed to be novel will become apparent in the attached claims. The invention, together with objectives and advantages thereof, may best be understood by reference to the following description of the presently preferred embodiments together with the accompanying drawings in which:

DETAILED DESCRIPTION OF THE PREFERRED EMBODIMENTS

A first embodiment of the present invention will now be described with reference to the attached drawings. FIGS. 1 to 14 show an example of an inkjet recording apparatus, a first embodiment of a liquid ejection apparatus including a tube pump according to the present invention.

Figure 1:
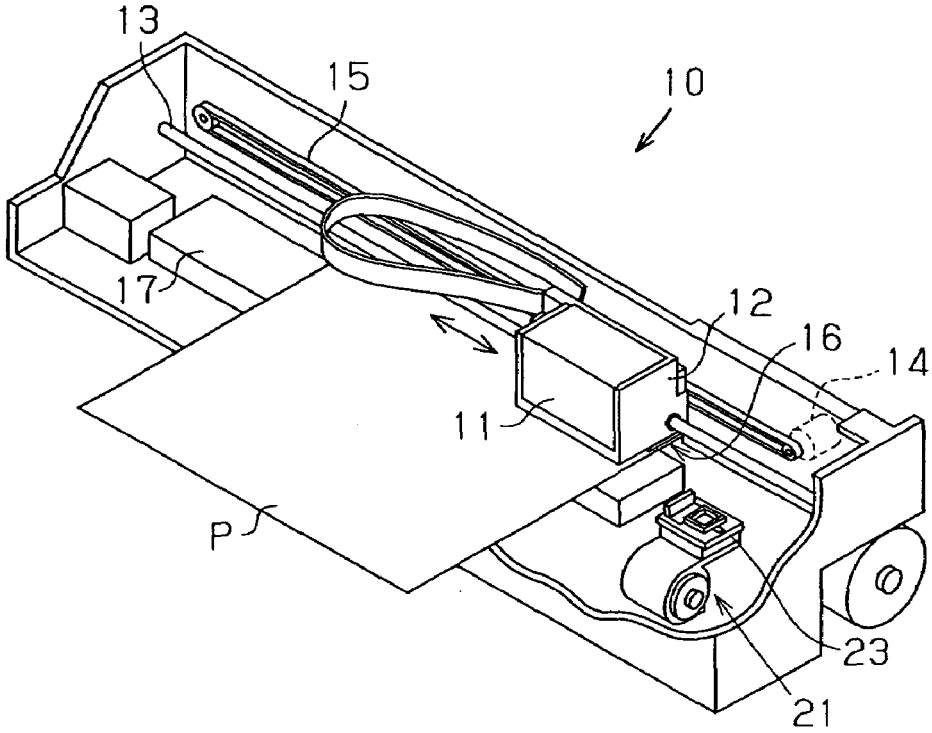
FIG. 1 is a perspective view showing an operating portion of an example of an inkjet recording apparatus according to a first embodiment of the present invention.
Figure 2:
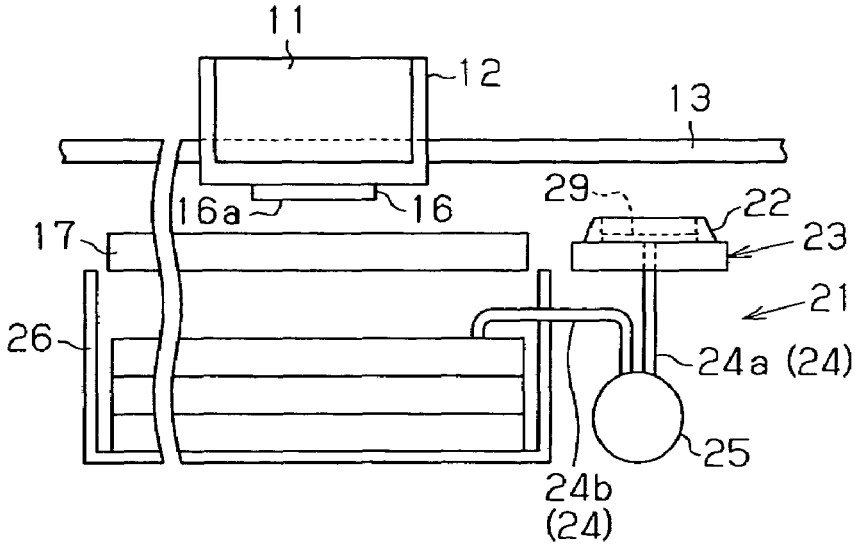
FIG. 2 is an elevation view schematically showing a main mechanism of the inkjet recording apparatus of FIG. 1.

The configuration of the apparatus will be first explained. As illustrated in FIGS. 1 and 2, an inkjet recording apparatus 10 has a carriage 12, in which an ink cartridge 11 including three primary color inks and a black ink, is accommodated. The carriage 12 is reciprocated by the drive force of a motor 14 transmitted via a belt 15, as guided by a guide 13 along a main scanning direction. The inkjet recording apparatus 10 discharges (ejects) ink (liquefied fluid) from the ink cartridge 11 through a non-illustrated nozzle, which is provided in a recording head 16 (a liquid ejection apparatus) formed at the bottom surface of the carriage 12.

The inkjet recording apparatus 10 feeds a recording sheet P to a platen 17 that extends in the main scanning direction along which the carriage 12 moves. The inkjet recording apparatus 10 discharges and ejects ink through the nozzle of the recording head 16, in a selective manner in correspondence with printing data. An image such as a character is thus formed on a recording surface of the recording sheet P. The ink discharging method of the recording head 16 is nonrestrictive and may be a pressing method that involves displacement of a piezoelectric (piezo) element or heating and vaporization with a heater.

In the inkjet recording apparatus 10, a head cleaning device 21 is located at a position near one end of the main scanning direction (a cleaning position) in the exterior of an image forming area. The head cleaning device 21 includes a cap mechanism 23 and a tube pump 25. As lifted by a non-illustrated lift means, the cap mechanism 23 presses a cap 22 serving as a seal means against a nozzle forming surface 16*a* at the bottom side of the recording head 16, defining a sealed space. A flexible tube 24 is accommodated in the tube pump 25 to draw and discharge fluid. The tube 24 has an upstream portion 24*a*, or a drawing side, and a downstream portion 24*b*, or a downstream side. The upstream portion 24*a* is connected with the sealed space formed by the cap mechanism 23. The downstream portion 24*b*, which is a discharge side, is connected with the interior of a discharged ink reservoir 26.

To assure that a smooth recording operation is performed repeatedly, the head cleaning device 21 is operated to activate the cap mechanism 23 and the tube pump 25 at predetermined timings. That is, the head cleaning device 21 draws the inside of the sealed space formed by the cap 22 through a passage 24*c* (FIG. 3) of the tube 24, in order to depressurize the sealed space. In this manner, the head cleaning device 21 performs head cleaning, or draws the ink from the nozzle of the recording head 16 and discharges the ink to the discharged ink reservoir 26. The cap 22 is shaped as a square frame such that the sealed space is formed by pressing the upper edge of the cap 22 against the nozzle forming surface 16*a* of the recording head 16. A sponge sheet 29 is fixed to the bottom of the cap 22 to suppress splashing of the ink drawn from the nozzle of the recording head 16.

Figure 3:
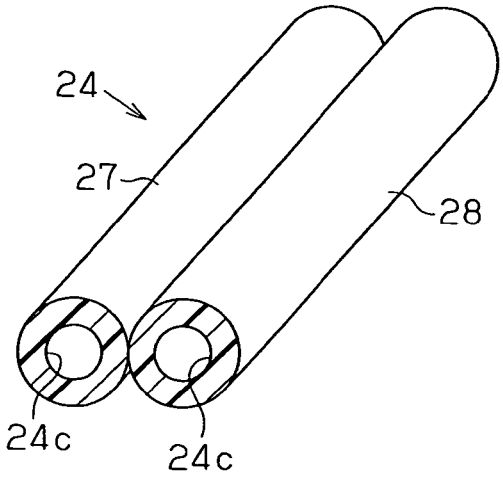
FIG. 3 is a perspective view showing a main part of the mechanism of FIG. 2.

As illustrated in FIG. 3, the flexible tube 24 is shaped as a double tube having two tube members 27, 28 aligned in parallel. The tube 24 is formed as one body from a flexible material such as silicone rubber through molding.

Figure 4:
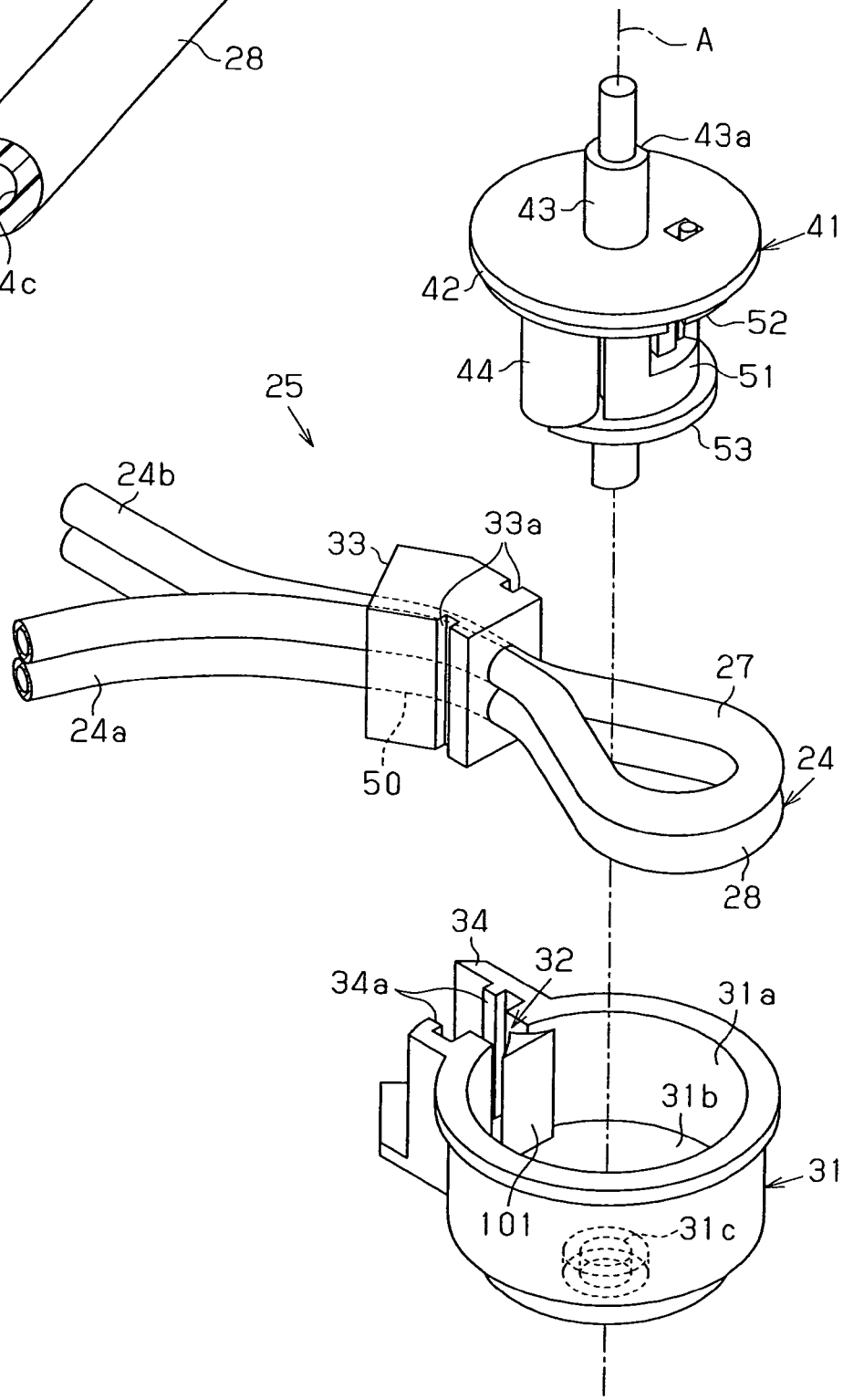
FIG. 4 is an exploded perspective view showing the configuration of a main portion of the inkjet recording apparatus of FIG. 1.

With reference to FIG. 4, the tube pump 25 is formed simply by assembling the tube 24, a lidded cylindrical, accommodating case 31 and a pressing device 41. The case 31 accommodates an intermediate portion of the tube 24 in such a manner that the tube 24 extends along an inner wall 31*a*. The pressing device 41 presses and squeezes the tube 24 against the inner wall 31*a* of the case 31.

An opening 32 is formed in the case 31 by cutting a portion of the inner wall 31*a*. The tube 24 may be passed through the opening 32 (to the interior of the case 31 and then to the exterior). An attaching portion 34 is formed outside the opening 32. A fixing block 33 for fixing the tube 24 is fitted in the attaching portion 34 or secured to the attaching portion 34 with a screw. The fixing block 33 functions as a holding member for holding the upstream portion 24*a* and the downstream portion 24*b*.

The flexible tube 24 has a first portion and a second portion that are located close to each other in the vicinity of the opening 32. The upstream portion 24*a* includes the first portion and a first extending portion that extends from the first portion to the exterior of the case 31 through the opening 32. The downstream portion 24*b* includes the second portion and a second extending portion that extends from the second portion to the exterior of the case 31 through the opening 32. The first extending portion is connected with the aforementioned sealed space. The second extending portion is connected with the discharged ink reservoir 26.

The fixing block 33 has a groove 33*a*. The attaching portion 34 has a projection 34*a*. The groove 33*a* and the projection

34*a* extend parallel with the axis of the case 31 (direction A in FIG. 4). By fitting the projection 33*b* in the groove 33*a*, the intermediate portion of the tube 24, which is supported by the fixing block 33, is positioned in and secured to the case 31 as extending along the inner wall 31*a*.

The case 31 includes an assistant member 101, which functions as a guide member, formed at a position corresponding to the opening 32. The assistant member 101 is shaped as a substantially triangular pole. The axial dimension of the assistant member 101 is substantially equal to that of the inner wall 31*a*. The assistant member 101 is formed from a highly deformable elastic material. The assistant member 101, which functions as a damper member, is located between the first portion and the second portion and has a substantially triangular cross-sectional shape. As viewed in FIG. 5, curved surfaces are formed along two slanted sides 101*a*, 101*b* of the assistant member 101, which extend along the inward portions of the outer circumferential surface of the tube 24 passed through the opening 32 in the case 31, or separate from the inner wall 31*a* (the sides 101*a*, 101*b* may be flat surfaces). A base surface 10*c*, located between the sides 101*a*, 101*b*, has a flat surface extending substantially parallel with a plane 35 extended from the inner wall 31*a* (indicated by the double dotted broken line in FIG. 5). The side 101*b*, which serves as a first surface, faces the first portion of the tube 24. The side 101*a*, which serves as a second surface, faces the second portion. The sides 101*a*, 101*b* each function as a contact surface. The base surface 101*c* of the assistant member 101 forms an assistant surface (guide surface) connected smoothly with the inward portions of the outer circumferential surface of the portions of the tube 24 passed through the opening 32 (the first and second portions) in the case 31.

Figure 5:
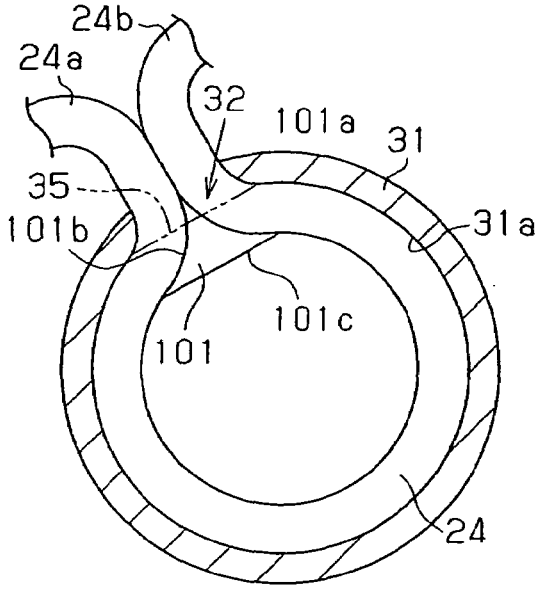
FIG. 5 is a partially cross-sectional plan view showing the configuration of FIG. 4.

The fixing block 33 accommodates the flexible tube 24 such that the tube members 27, 28 are aligned in parallel along the axial direction of the case 31. The tube 24 is fixed in a curled manner forming a substantial U shape (substantially in an arched manner), such that the flow direction of fluid is turned accordingly. With reference to FIG. 5, when the tube 24 is accommodated in the case 31, the ends of the tube 24 project from the fixing block 33 (not illustrated in the drawing) while the portion of the tube 24 in the case 31 extends along the inner wall 31*a*. The projecting ends of the tube 24 are separated from each other such that the tube 24 forms a Ω shape. This arrangement makes it unnecessary to overlap one portion of the tube 24 with another along the axial direction of the case 31. The case 31 thus becomes compact. Further, although the flexible tube 24 includes the tube members 27, 28 formed as one body, the tube 24 may have a single tube or three or more tubes. Also, the tubes may be simply aligned in parallel without forming one body.

The pressing device 41 has a rotary disk 42 with a rotary shaft 43. The rotary shaft 43 is rotationally supported by a shaft hole 31*c* formed at the center of the bottom 31*b* of the case 31. A support 51 is connected with the disk 42 such that the support 51 is rotated substantially integral with the disk 42 in the case 31. A roller 44 is rotationally supported by the support 51. That is, the disk 42 and the support 51 support the roller 44 in such a manner that the roller 44 is located in the vicinity of the inner wall 31*a* of the case 31. The disk 42 is actuated by a non-illustrated motor engaged with a flat cutout portion 43*a* formed at one end of the rotary shaft 43.

In other words, by enabling the disk 42 to rotate around the axis A (the cylindrical axis A of the case 31), the pressing device 41 operates to roll (revolve) the roller 44 along the inner wall 31*a* of the case 31. That is, while pressing and squeezing the tube 24 against the inner wall 31*a* of the case 31, the roller 44 shifts the position at which the tube 24 is pressed along the revolving direction of the roller 44. The roller 44, functioning as a pressing member, revolves around the axis A.

In this manner, the tube pump 25 depressurizes (produces negative pressure in) the upstream portion 24*a*, which is connected with the sealed space formed by the cap mechanism 23. The ink is thus drawn from the nozzle of the recording head 16. Meanwhile, the pump 25 pressurizes the downstream portion 24*b*, which is connected with the discharged ink reservoir 26, urging the drawn ink to be discharged.

Figure 6:
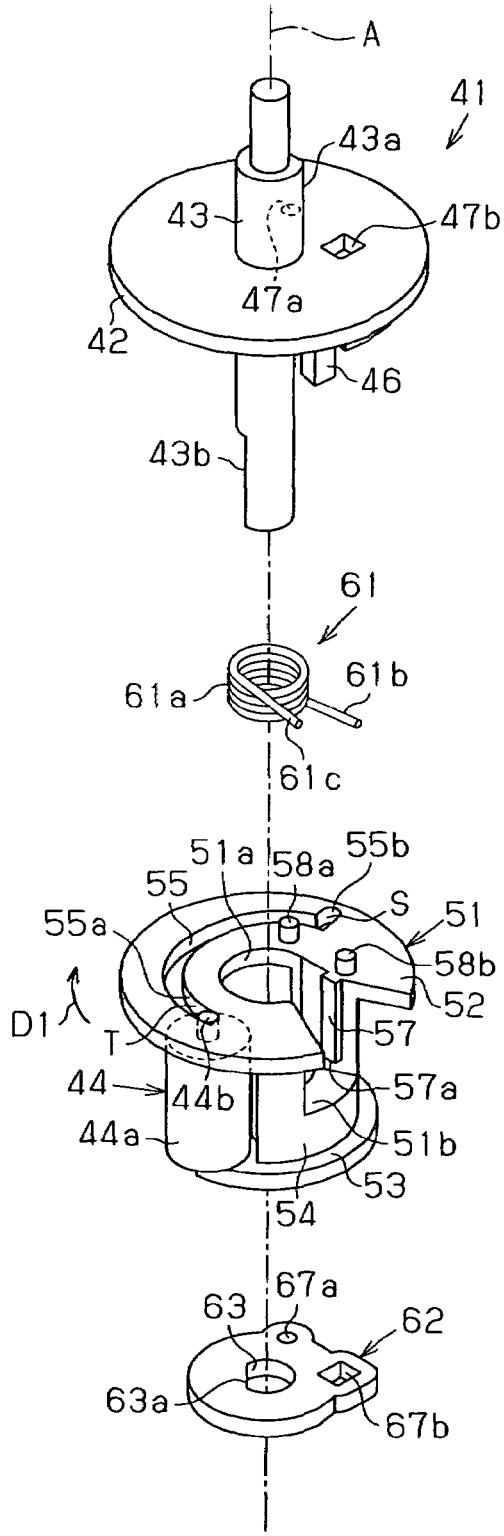
FIG. 6 is an exploded perspective view showing the configuration of FIG. 4.

More specifically, with reference to FIG. 6, the pressing device 41 has a simple structure configured by assembling the rotary disk 42, the roller 44, the support 51, a coil spring 61, and a stopper 62.

Figure 8:
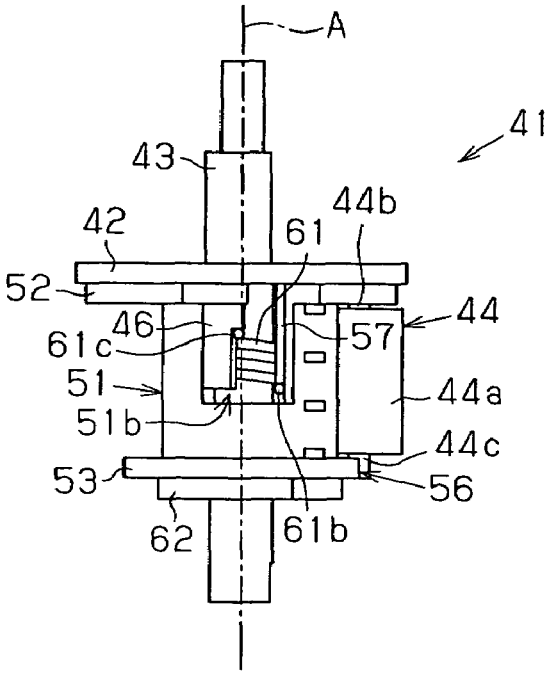
FIG. 8 is an elevation view explaining the function of the configuration of FIG. 4.
Figure 9:
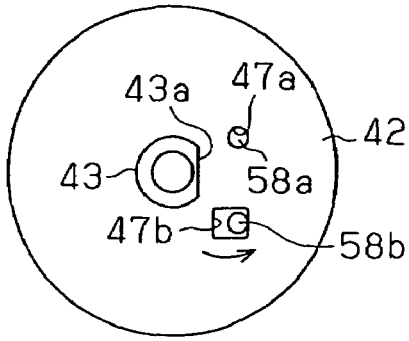
FIG. 9 is a plan view explaining the function of the configuration of FIG. 4.

The support 51 is formed integrally by connecting an upper plate 52 with a lower plate 53, which oppose each other, by means of a connecting body 54. A C-shaped guide groove 55 extends through the upper plate 52. The guide groove 55 has an arched shape that corresponds to a half of a substantial circumference of the disk 42 around the axis A. As shown in FIG. 8, the lower plate 53 has a small diameter portion 56. The outer circumferential surface of the small diameter portion 56 is located at a circumferential position corresponding to that of an inner circumferential surface 55*a* of the groove 55. Also, the outer circumferential surface of the small diameter portion 56 is shaped in correspondence with the inner circumferential surface 55*a* of the groove 55. The remainder of the lower plate 53 has a relatively large diameter.

A retreat position T is located at a proximal end of a path indicated by arrow D1 in FIG. 6, while an operating position S is located at a distal end of the path. With reference to FIGS. 6 and 8, the inner circumferential surface 55*a* of the groove 55 and the outer circumferential surface of the small diameter portion 56 of the support 51 extend to be radially spaced from the axis A of the disk 42, gradually from the retreat position T toward the operating position S.

In the support 51, one of the rotary shafts of the roller 44, or a rotary shaft 44*b*, is supported by and guided in the guide groove 55 of the upper plate 52. The other rotary shaft of the roller 44, or a rotary shaft 44*c* (FIGS. 8 and 10), is guided along the outer circumferential side of the small diameter portion 56. A roller portion 44*a* of the roller 44 is clamped between the upper plate 52 and the lower plate 53 such that the roller portion 44*a* is permitted to be revolved in a substantially circumferential direction.

Therefore, the roller 44 is rotationally supported, with the roller portion 44*a* maintained in a state parallel with the axis A of the disk 42. The roller 44 is allowed to move within a predetermined range (between the retreat position T and the operating position S of the groove 55 of FIG. 6) in a substantially circumferential direction around the axis A. The roller 44 is capable of reciprocating between the retreat position T and the operating position S.

In other words, when the disk 42 is rotated in a direction opposite to the direction indicated by arrow D1 of FIG. 6, the roller 44 of the pressing device 41 is urged to move from the retreat position T to the operating position S in the groove 55. The roller 44 thus becomes separated from the axis A of the disk 42 gradually in the radial direction. Accordingly, the pressure for squeezing the tube 24 extending along the inner wall 31*a* of the case 31 is increased.

The support 51 also includes an attaching groove 55*b* that extends radially outward from the outer circumferential surface of the groove 55 of the upper plate 52. By fitting the rotary shaft 44*b* of the roller 44 in the attaching groove 55*b*, the rotary shaft 44*c* of the roller 44 is easily positioned at a position abutted by the outer circumferential surface of the small diameter portion 56. Although a single roller 44 is employed in the illustrated embodiment, the present invention is not restricted to this structure and may include two or more rollers.

Further, a through hole 51*a* extends through the centers of the upper plate 52, the lower plate 53 and the connecting body 54 of the support 51. A cut-out portion 51*b* is defined in a predetermined area of the upper plate 52 and the connecting body 54 at a position opposed to the guide groove 55. The cut-out portion 51*b* extends to a position in the vicinity of the lower plate 53. The through hole 51*a* is capable of receiving the rotary shaft 43 of the disk 42 that is passed through a body 61*a* of the coil spring 61. A cross section of the cut-out portion 51*b* perpendicular to the axis A of the disk 42 has an arcuate shape with respect to the axis A.

A projection 57 projects from the side wall of the cut-out portion 51*b* at the side of the distal end of the guide groove 55 (the operating position S). The projection 57 extends parallel with the axis A of the disk 42 and reaches the position spaced from the bottom of the lower plate 53. An engaging recess 57*a* is defined between the projection 57 and the bottom surface of the lower plate 53. The engaging recess 57*a* is capable of engaging with an arm 61*b* of the coil spring 61, with the rotary shaft 43 of the disk 42 passed through the body 61*a*.

Figure 7:
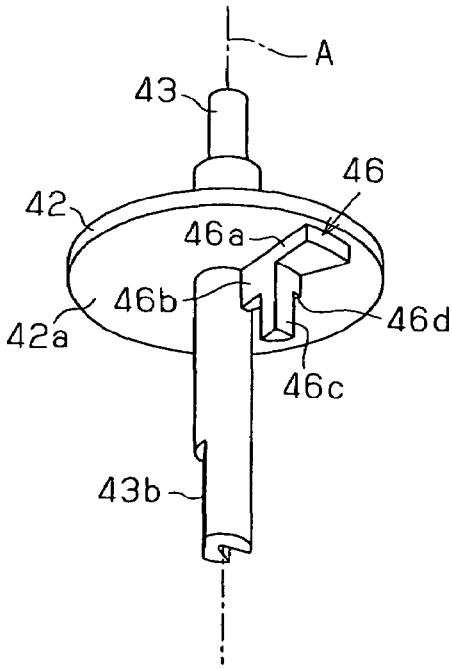
FIG. 7 is a perspective view showing a main part of the configuration of FIG. 4.

The disk 42 includes an engaging projection 46 that projects from a lower side 42*a* of the disk 42 (FIG. 7). The engaging projection 46 is received in the cut-out portion Sib of the support 51. With reference to FIG. 7, the engaging projection 46 includes a first block 46*a*, a second block 46*b*, and a third block 46*c*.

The first block 46*a* is formed in an arcuate shape around the axis A of the disk 42, with the axial dimension and diameter equal to those of the upper plate 52. The angle defined by the arcuate shape (the extending angle) is selected such that the first block 46*a* has a smaller cross section than that of the cut-out portion 51*b* of the support 51. The second block 46*b* has an arcuate shape with the extending angle equal to that of the first block 46*a*. However, the diameter of the second block 46*b* is equal to that of the connecting body 54 of the support 51. The axial dimension of the second block 46*b* is larger than that of the first block 46*a*. The third block 46*c* projects from an end of the second block 46*b* spaced from the axis A of the disk 42. The third block 46*c* is shaped as a triangular pole such that, when located in the cut-out portion 51*b* of the cut-out portion 51*b* of the support 51, the third block 46*c* projects parallel with the axis A of the disk 42 at a side spaced from the projection 57.

Thus, as viewed in FIG. 7, the left sides of the first to third blocks 46*a* to 46*c* are formed as one continuous flat surface. This enables the projection 46 of the disk 42 to contact a corresponding wall of the cut-out portion 51*b* of the support 51 (the side opposed to the projection 57) in a surface contact manner. The projection 46 is thus capable of pressing uniformly. Further, the opposed right side of the projection 46 includes a step 46*d* formed between the second block 46*b* and the third block 46*c*. The step 46*d* is arranged to receive an arm 61*c* of the coil spring 61, with the arm 61*b* of the coil spring 61 engaged with the engaging recess 57*a* of the support 51. In this manner, the resilient force produced by the coil spring 61, with the rotary shaft 43 of the disk 42 passed through the body 61*a*, urges the projection 46 of the disk 42 and the projection 57 of the support 51 away from each other. Although the illustrated embodiment employs the coil spring 61, the present invention is not restricted to this structure. Obviously, the coil spring 61 may be a plate spring, other types of springs, or a rubber member.

The stopper 62 is shaped as a disk with a relatively small diameter. A shaft hole 63 is formed in the stopper 62 for supporting the rotary shaft 43 of the disk 42. The shaft hole 63 has a flat portion 63*a* that is engaged with a cut-out portion 43*b* of the shaft 43, opposed to a cut-out portion 43*a*. The shaft hole 63 is thus engaged with the rotary shaft 43 such that the shaft hole 63 and the rotary shaft 43 are prohibited from rotating relative to each other. This structure connects the stopper 62 with the disk 42 such that the stopper 62 is rotated integrally with the disk 42.

Further, the disk 42 has a circular hole 47*a*, and the stopper 62 has a circular hole 67*a*. An elongated hole 47*b* is formed in the disk 42 and extends along a circumference around the circular hole 47*a*. In the same manner, an elongated hole 67*b* is formed in the stopper 62 and extends along a circumference around the circular hole 67*a*. A plurality of projections 58*a*, 58*b* project from an upper side of the upper plate 52 and a lower side of the lower plate 53 of the support 51 (only those of the upper plate 52 are shown in FIG. 6) at corresponding positions, as viewed in FIG. 6. By engaging the projections 58*a* and 58*b* of the support 51 respectively with the circular hole 47*a* and the elongated hole 47*b*, the disk 42 and the stopper 62 are allowed to rotate relative to each other in a range defined by the elongated holes 47*b*, 67*b*. At the same tine, this structure enables the support 51 to be rotated substantially integral with the disk 42 and the stopper 62.

The assembling process of the tube pump 25 will hereafter be explained. First, as shown in FIG. 6, the support 51 and the roller 44 are prepared. The rotary shaft 44*b* of the roller 44 is fitted in the attaching groove 55*b* of the guide groove 55 of the upper plate 52 of the support 51. The rotary shaft 44*b* is thus placed in contact with the inner circumferential surface 55*a* of the guide groove 55. In this state, the rotary shaft 44*c* is abutted by the outer circumferential surface of the small diameter portion 56 of the lower plate 53. This structure allows the roller 44 to be freely rotated (rotated on its axis) and rolled (moved, or revolved, along a circumferential direction of the lower plate 53).

Next, the rotary disk 42 and the coil spring 61 are prepared. The rotary shaft 43 of the disk 42 is passed through the body 61*a* of the coil spring 61. With the rotary shaft 43 passed through the coil spring 61, the arm 61*c* of the coil spring 61 is engaged with the step 46*d* of the projection 46, which is located between the second block 46*b* and the third block 46*c*. The rotary shaft 43 of the disk 42 is then inserted in the through hole 51*a* of the support 51. Further, the arm 61*c* of the coil spring 61, which is located at the side of the disk 42, is brought closer to the opposite arm 61*b*. Meanwhile, the arm 61*b* is then engaged with the engaging recess 57*a*, which is defined by the projection 57 of the support 51. At the same time, the projection 58*a* of the support 51 is fitted in the circular hole 47*a* of the disk 42 and the projection 58*b* of the support 51 is fitted in the elongated hole 47*b* of the disk 42. The rotary disk 42 and the support 51 are thus connected with each other.

The stopper 62 is then prepared. The rotary shaft 43 of the disk 42 projecting from the lower plate 53 of the support 51 is fitted in the shaft hole 63 of the stopper 62, such that the cut-out portion 43*b* is engaged with the flat portion 63*b*. At the same time, as in the connection between the rotary disk 42 and the support 51, a non-illustrated projection of the support 51 is fitted in the circular hole 67*a* and another in the elongated hole 67*b*. The stopper 62 is thus connected with the disk 42 and the support 51, and the assembling process of the pressing device 41 is completed.

As shown in FIG. 8, when the pressing device 41 in the assembled state is free from the force acting to rotate the disk 42 and the support 51 relative to each other, the resilient force produced by the arms 61*b* and 61*c*, which operate to be spaced from each other, urges the projection 46 of the disk 42 to be spaced from the projection 57 of the support 51. The projection 46 thus uniformly presses the corresponding wall of the cut-out portion 51*b* of the support 51. In this state, with the projection 58*a* of the support 51 engaged with the circular hole 47*a* of the disk 42, the resilient force of the coil spring 61 acts in a direction indicated by the arrow of FIG. 9 around the projection 58*a*. Thus, if no external force is applied, the projection 58*b* is located at the right end of the elongated hole 47*b* of the disk 42, as viewed in FIG. 9.

Figure 10:
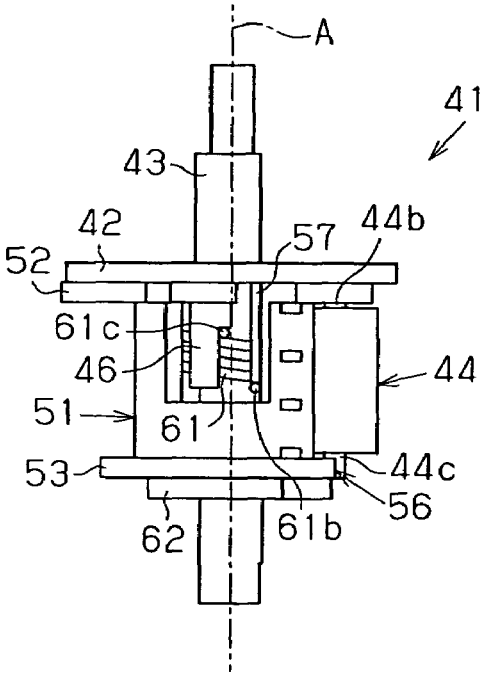
FIG. 10 is an elevation view explaining the function of the configuration of FIG. 4.
Figure 11:
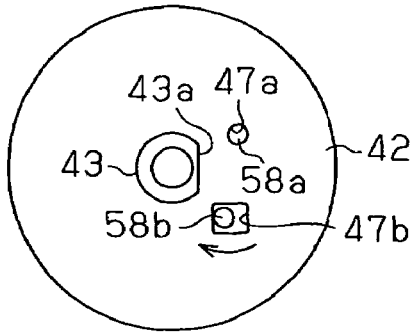
FIG. 11 is a plan view explaining the function of the configuration of FIG. 4.
Figure 12:
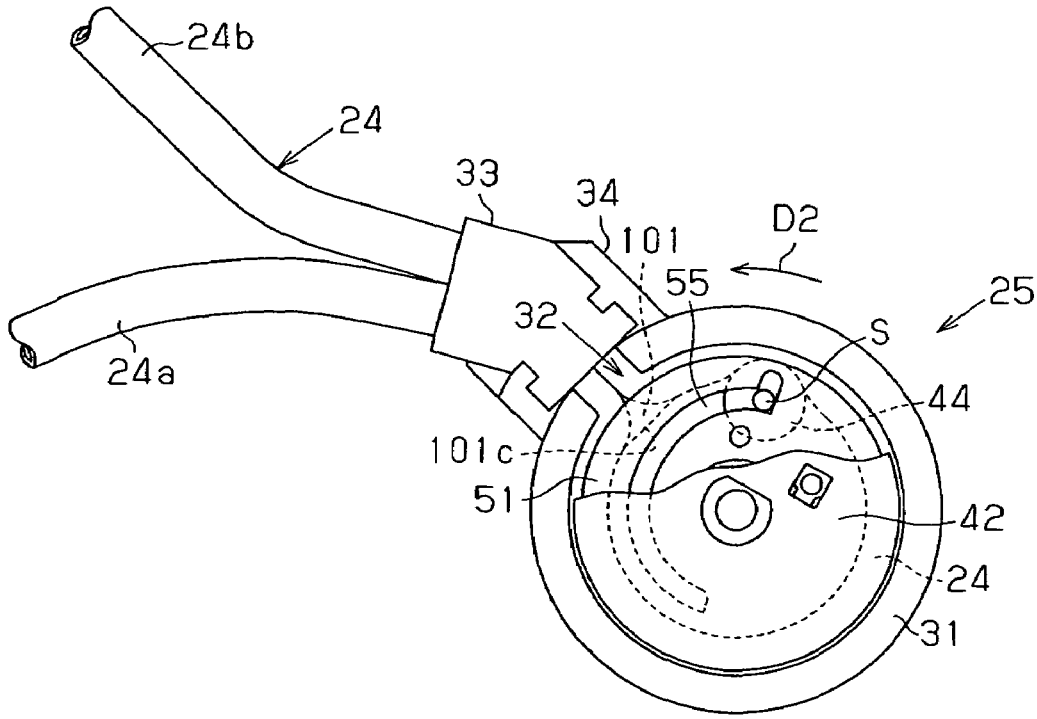
FIG. 12 is a partially cut-away plan view explaining the operation of the configuration of FIG. 4.

With reference to FIG. 10, if the disk 42 and the support 51 of the pressing device 41, or the roller 44, receive the force causing the arms 61*b*, 61*c* to approach each other against the force of the coil spring 61, the projection 46 of the disk 42 and the projection 57 of the support 51 approach each other. In this state, with the projection 58*a* of the support 51 engaged with the circular hole 47*a* of the disk 42, the support 51 is urged to rotate relative to the disk 42, in a direction indicated by the arrow of FIG. 11 around the projection 58*a*. The projection 58*b* is thus located at the left end of the elongated hole 47*b* of the disk 42, as viewed in FIG. 11.

In other words, when the roller 44 of the pressing device 41 is located at the operating position S in the guide groove 55 of the support 51 (FIG. 6) and is free from any type of force, the roller 44 is placed at the position most spaced from the axis A of the disk 42, with reference to FIG. 8. Further, when the force acting to pivot the projection 58*b* of the support 51 in the elongated hole 47*b* of the disk 42 against the resilient force of the coil spring 61 is applied to the roller 44 located at the operating position S, the roller 44 is placed at a position close to the axis A of the disk 42, with reference to FIG. 10.

That is, the projection 58*b* of the support 51 is permitted to pivot in the elongated hole 47*b* of the disk 42 in accordance with the force acting on the roller 44. The roller 44 of the pressing device 41 is thus moved toward or away from the axis A of the rotary disk 42 in accordance with the force (the reactive force) acting on the roller 44. This structure, as will be described later, enables the force of the roller 44 acting to press the flexible tube 24 against the inner wall 31*a* of the case 31 (the pressing force) to be adjusted by the resilient force of the coil spring 61. Further, if the roller 44 of the pressing device 41 receives the force acting in the direction opposite to the direction along which the guide groove 55 extends beyond the operating position S, the roller 44 is retreated to the retreat position T (FIG. 6) in the guide groove 55 of the support 51, the position closest to the axis A of the disk 42.

Next, as illustrated in FIG. 4, the groove 33*a* of the attaching portion 34 of the case 31 is engaged with the projection 34*a* of the fixing block 33, to which the flexible tube 24 is fixed. At this stage, the tube 24 is passed through the space between the periphery of the opening 32 and the slanted sides 101*a*, 101*b* of the assistant member 101, such that both ends of the tube 24 are separated from each other. The intermediate portion of the tube 24 is thus placed along the inner wall 31*a* of the case 31.

Afterwards, the pressing device 41 is inserted in the space surrounded by the tube 24 from the side corresponding to the stopper 62, or the lower plate 53. The distal end of the rotary shaft 43 of the disk 42 is rotationally fitted in the shaft hole 31*c* of the bottom 31*b* of the case 31, thus completing the assembly of the tube pump 25. In this state, the roller 44 of the pressing device 41 is held in a pressing state in which the roller 44 slightly presses an intermediate portion of the tube 24 against the inner wall 31*a* of the case 31.

Cleaning of the recording head 16 by the head cleaning device 21 will hereafter be explained. First, the carriage 12 is moved to a cleaning position in the exterior of the image forming area of the inkjet recording apparatus 10. The cap 22 of the cap mechanism 23 is then lifted to a position tightly fitted to the nozzle forming surface of the recording head 16, forming a sealed space. The drive force of the non-illustrated motor is then transmitted to the rotary shaft 43 of the disk 42, and the pressing device 41 starts to rotate in a counterclockwise direction indicated by arrow D2 of FIG. 12 (a positive revolving direction in which the roller 44 moves from the upstream portion 24*a* of the tube 24, or the side of the recording head 16, to the downstream portion 24*b*, or the side of the discharged ink reservoir 26).

Since the roller 44 presses the tube 24 at this stage, a friction force acts on the tube 24 in a clockwise direction. The roller 44 is thus guided in the guide groove 55 of the disk 42 as following the relative rotation of the tube 24. In this manner, the roller 44 is rotated and revolved (rolled) to the operating position S, or the distal end of the guide groove 55.

Since the roller 44 is prohibited from moving further beyond the distal end of the guide groove 55 of the disk 42, the roller 44 is maintained at the operating position S and is rotated (turned, as indicated by arrow D4 in FIG. 22) clockwise at this position. Thus, the roller 44 continuously presses and squeezes an intermediate portion of the tube 24 against the inner wall 31*a* of the case 31, shifting the pressing position of the tube 24 along the positive (counterclockwise) revolving direction indicated by arrow D2 of FIG. 12. If the roller 44 is held at the position S and the reactive force produced by the tube 24 in the pressed state is increased, the roller 44 is displaced toward the axis A of the disk 42 by the resilient force of the coil spring 61. The increased force is thus absorbed. This structure allows the roller 44 to press the tube 24 with a stable pressing force.

In this manner, by changing the volume of the interior of the tube 24, the tube pump 25 depressurizes the portion of the tube 24 at the side of the recording head 16 with respect to the roller 44, or the upstream portion 24*a*, which is the suction side. Negative pressure is thus produced in the sealed space defined by the cap 22, such that ink or gas is drawn from the nozzle of the recording head 16. Meanwhile, the tube pump 25 pressurizes the portion of the tube 24 at the side of the discharged ink reservoir 26 with respect to the roller 44, or the downstream portion 24*b*, which is the discharge side. The ink or gas drawn from the nozzle of the recording head 16 is thus urged to be discharged to the discharged ink reservoir 26.

Figure 13:
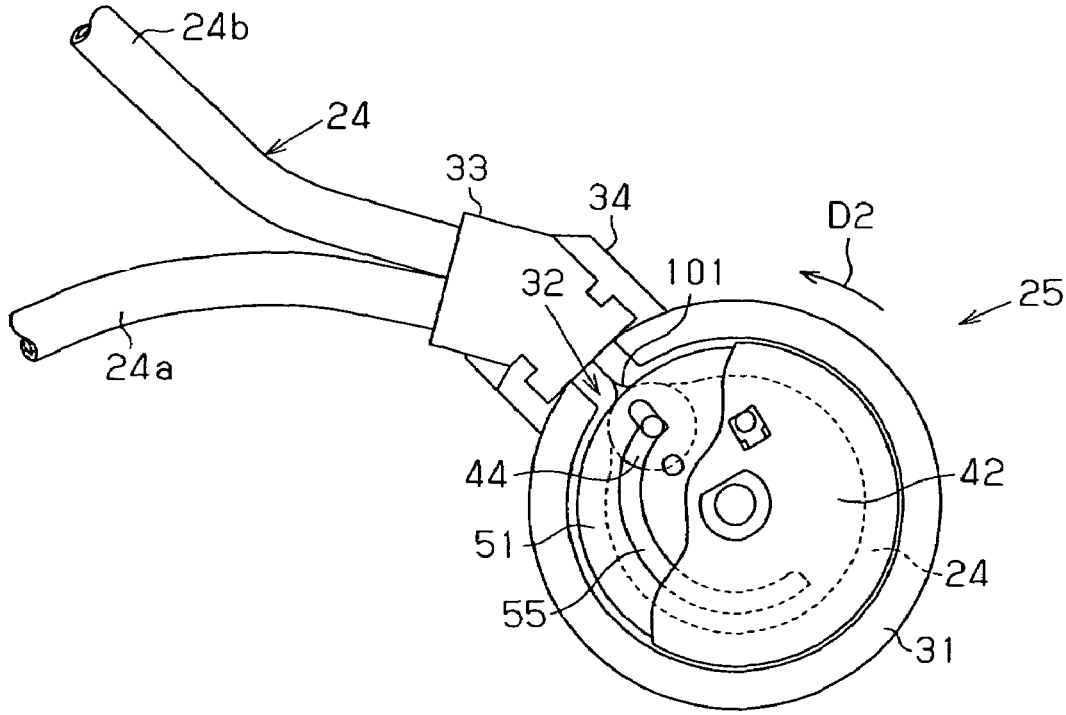
FIG. 13 is a partially cut-away plan view explaining the operation of the configuration of FIG. 4.

With reference to FIG. 13, during this positive revolving operation, the tube pump 25 repeatedly passes the point at which one portion of the flexible tube 24 is abutted by another in the vicinity of the opening 32 (the point corresponding to the first and second portions).

In this state, if the outer circumferential surface of the tube 24 approaches the axis A of the disk 42 and the reactive force of the tube 24 is decreased, the roller 44 pivots separately from the axis A of the disk 42, such that the resilient force of the coil spring 61 compensates the decreased force. The roller 44 thus presses the tube 24 effectively.

Further, the case 31 includes the assistant member 101, the base surface (assistant surface) 101*c* of which is connected smoothly with the outer circumferential surface of the portion of the tube 24 passed through the opening 32. When passing the vicinity of the opening 32, the roller 44 moves first from the outer circumferential surface of the downstream portion 24*b* (more specifically, the second portion) to the base surface 101*c* of the assistant member 101. Then, as elastically deforming the assistant member 101, the roller 44 moves from the base surface 101*c* of the assistant member 101 to the outer circumferential surface of the upstream portion 24*a* (more specifically, the first portion). Therefore, the roller 44 is capable of avoiding an impact otherwise caused by moving from the outer circumferential surface of the downstream portion 24*b* to the outer circumferential surface of the opposed, upstream portion 24*a*, which have different surface conditions. Further, while elastically deforming the assistant member 101, the roller 44 presses and squeezes the upstream portion 24*a* and the downstream portion 24*b* that are passed through the opening 32, against the inner wall 31*a* at opposite sides of the opening 32. The roller 44 thus prevents the negative pressure in the tube 24 from being released.

Thus, when the pressing device 41 is revolved in the positive revolving direction, the tube pump 25 suppresses the noise production due to the impact between the roller 44 and the tube 24, which noise would be otherwise repeatedly brought about. Further, regardless of at which position the roller 44 is located in the case 31, the roller 44 is constantly held in the state pressing an intermediate portion of the tube 24. In other words, the tube pump 25 prevents the negative pressure in the tube 24 between the recording head 16 and the discharged ink reservoir 26 from being released. Also, the tube pump 25 repeatedly revolves the roller 44 silently, such that the negative pressure in the tube 24 is gradually accumulated. This structure ensures a smooth cleaning operation of the head cleaning device 21.

Figure 14:
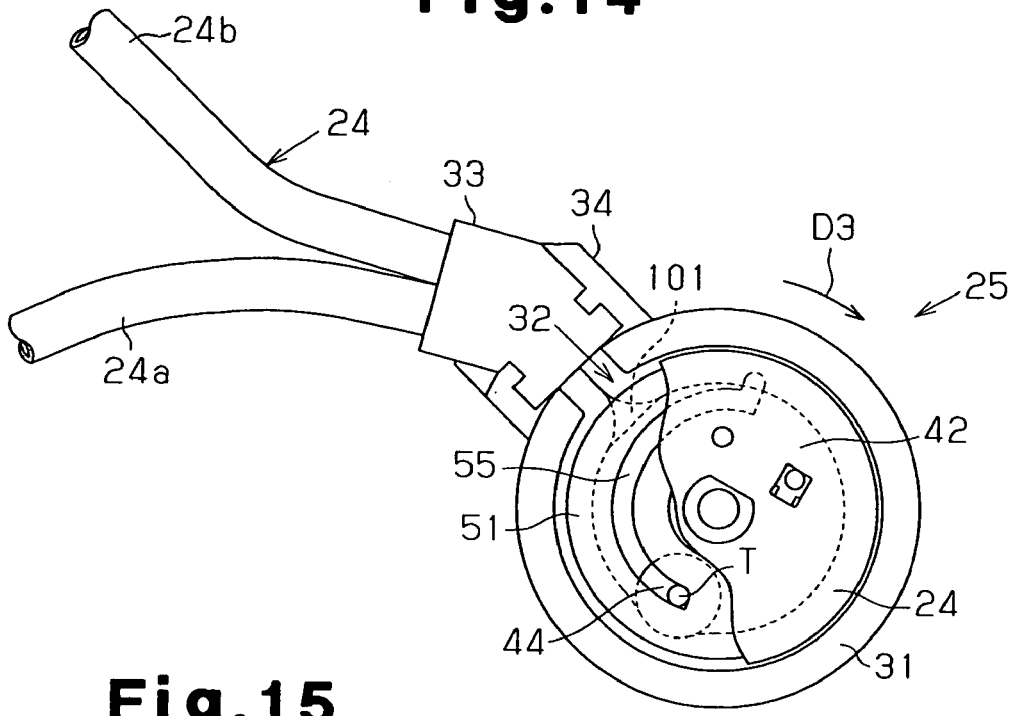
FIG. 14 is a partially cut-away plan view explaining the operation of the configuration of FIG. 4.

After finishing the cleaning operation, as illustrated in FIG. 14, the head cleaning device 21 rotates the pressing device 41 of the tube pump 25 in the direction indicated by arrow D3 of FIG. 14 (the reverse revolving direction), guiding the roller 44 in the guide groove 55 of the disk 42. In this state, the roller 44 is rotated (turned) counterclockwise by the friction force between the roller 44 and the tube 24. The roller 44 is thus rolled (revolved) to the retreat position T, located at the proximal end of the groove 55. Therefore, at the retreat position T, which is most spaced from the inner wall 31*a* of the case 31, the roller 44 releases the force acting to press the tube 24. The tube 24 and the assistant member 101 are thus protected from deterioration due to pressing and deformation when the cleaning operation is not performed.

As described above, in the illustrated embodiment, the roller 44 of the pressing device 41, which presses and squeezes the flexible tube 24 against the inner wall 31*a* of the case 31, moves along the base surface 101*c* (the assistant surface) of the assistant member 101 connected smoothly with the outer circumferential surface of the tube 24, when passing the vicinity of the opening 32 through which the tube 24 is passed. In this state, the roller 44 is revolved as deforming both of the tube 24 and the assistant member 101.

Therefore, although the condition of the outer circumferential surface of the tube 24 is greatly varied in the vicinity of the opening 32 of the case 31, the roller 44 suppresses the noise production, which would otherwise be caused repeatedly by the impact between the roller 44 and the upstream portion 24*a* to which the roller 44 is transferred. Further, while maintaining the negative pressure in the tube 24, the roller 44 is repeatedly transferred from the downstream portion 24*b* to the upstream portion 24*a*, passing the vicinity of the opening 32 of the case 31.

Accordingly, the tube pump 25 effectively draws ink from the recording head 16 without generating a noise such as the one caused by the impact. Further, the tube pump 25 completes the cleaning operation of the inkjet recording apparatus 10 efficiently and silently.

Figure 15:
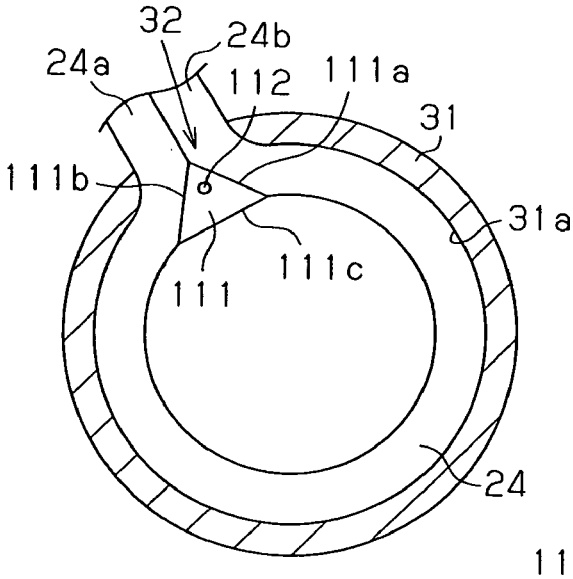
FIG. 15 is a partially cross-sectional plan view showing the configuration of a main portion of an inkjet recording apparatus according to a second embodiment of the present invention.
Figure 16:
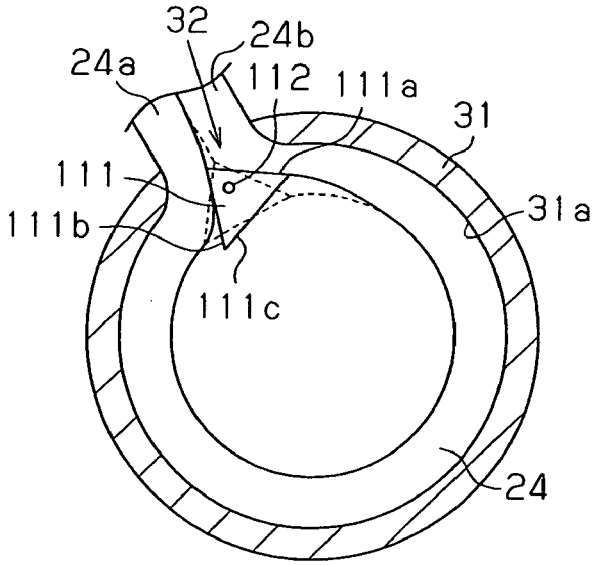
FIG. 16 is a partially cross-sectional plan view explaining the operation of the configuration of FIG. 15.

FIGS. 15 and 16 show an example of an inkjet recording apparatus, a second embodiment of a liquid ejection apparatus having a tube pump according to the present invention. Since the second embodiment is configured substantially identical with the first embodiment, the same or like reference numerals are given to parts of the second embodiment that are the same or like corresponding parts of the first embodiment. Only the characteristics of the second embodiment will be described herein (the remaining embodiments will be described in the same manner).

As shown in FIG. 15, the accommodating case 31, which is a constituent of the tube pump 25 of the head cleaning device 21 of the inkjet recording apparatus 10, includes an assistant member 111, in place of the assistant member 101 of the first embodiment.

Like the assistant member 101, the assistant member 111 is shaped as a substantially triangular pole with the axial dimension equal to that of the inner wall 31*a* of the case 31. However, unlike the assistant member 101, the assistant member 111 is formed from an elastic material with hardness sufficient for suppressing major deformation.

In the substantially same manner as the assistant member 101 of the first embodiment, the assistant member 111 includes a triangular cross-sectional shape that extends along the inward portions of the outer circumferential surface of the tube 24 passed through the opening 32 in the case 31. The assistant member 111 includes two slanted sides 111*a*, 111*b* of the triangular shape and a base surface 111*c*, which is located between the slanted sides 111*a*, 111*b*.

The slanted sides 111*a*, 111*b* of the assistant member 111 are formed as flat surfaces. The base surface 111*c* of the assistant member 111 is formed as a flat surface substantially parallel with the extended plane 35 extended from the inner wall 31*a* at the position corresponding to the opening 32. The base surface 111*c* serves as an assistant surface connected smoothly with the inward portions of the outer circumferential surface of the tube 24 passed through the opening 32 in the case 31. The slanted sides 111*a*, 111*b* may be formed as curved surfaces as in the case of the first embodiment. However, the slanted sides 111*a*, 111*b* are formed as the flat surfaces for obtaining sufficient strength for pivotal movement of the assistant member 111, as will be later described later. The tube pump 25 including the assistant member 111 may be assembled in the same manner as the first embodiment.

The assistant member 111 is pivotally supported by a pivot shaft 112, located inward from a position corresponding to the opening 32 of the case 31 and in the vicinity of the point between the slanted sides 111*a*, 111*b*.

Thus, when the tube pump 25 is operated in accordance with the positive revolution (the cleaning operation of the head cleaning device 21) and the roller 44 is located in the vicinity of the opening 32 of the case 31, the roller 44 contacts and pivots the assistant member 111 in a counterclockwise direction of FIG. 16 (in a second direction), as indicated by the solid lines. The roller 44 then proceeds to the base surface 111*c* connected smoothly with the outer circumferential surface of the downstream portion 24*b*. The roller 44 then moves further in a direction away from the opening 32 of the case 31 and past the pivot shaft 112. At this stage, or when the roller 44 moves past the line connecting the revolution axis A with the pivot shaft 112 (the pivot axis), the roller 44 quickly pivots the assistant member 111 in a clockwise direction of FIG. 16 (in a first direction). The roller 44 then moves from the base surface 111*c* to the outer circumferential surface of the upstream portion 24*a* connected smoothly with the base surface 111*c*.

More specifically, as pivoted by the roller 44, the slanted side 111*a* of the assistant member 111 presses the downstream portion 24*b* pressed by the roller 44 against the inner wall 31*a* of the case 31, with respect to the portion of the inner wall 31*a* corresponding to the associated one of the sides of the opening 32. In this state, the assistant member 111 allows the roller 44 to transfer to the base surface 111*c*.

When the roller 44 moves further in the direction away from the opening 32 of the case 31 along the base surface 111*c*, the pivotal direction of the assistant member 111 is quickly reversed. In this state, while pressing the upstream portion 24*a* between the slanted side 111*b* and the portion of the inner wall 31*a* of the case 31 corresponding to the opposing side of the opening 32, the assistant member 111 allows the roller 44 to return to the upstream portion 24*a*.

Therefore, when the roller 44 passes the vicinity of the opening 32 of the case 31, the assistant member 111 minimizes the time in which the pressing of the tube 24 is suspended, thus preventing the negative pressure in the tube 24 from being released. In other words, the roller 44 suspends the pressing of the tube 24 only instantly and slightly when passing in the vicinity of the opening 32. The roller 44 is thus smoothly transferred from the downstream portion 24*b* to the upstream portion 24*a*.

At this stage, like the first embodiment, the roller 44 proceeds to the opposed position of the tube 24 via the base surface 111*c* of the assistant member 111. This suppresses the impact between the roller 44 and the outer circumferential surface of the tube 24 to which the roller 44 is transferred, which impact would otherwise be caused by the varied surface condition of the inward portions of the outer circumferential surface of the tube 24 in the case 31. Further, after the roller 44 returns to the outer circumferential surface of the upstream portion 24*a*, the assistant member 111 receives the recovering resilient force of the tube 24 from both of the upstream portion 24*a* and the downstream portion 24*b*. The assistant member 111 is thus pivotally returned to a neutral posture, suspending the pressing of the tube 24.

In this manner, the tube pump 25 prevents the negative pressure in the tube 24 between the recording head 16 and the discharged ink reservoir 26 from being released. Also, the tube pump 25 repeatedly revolves the roller 44 without producing a noise, such that the negative pressure in the tube 24 is gradually accumulated. This structure ensures a smooth cleaning operation of the head cleaning device 21.

As has been described, the second embodiment has the same operational effects as those of the first embodiment. The tube pump 25 is thus capable of performing the cleaning operation of the inkjet recording apparatus 10 efficiently and silently. In addition, since the assistant member 111 is relatively hard as compared to the assistant member 101 of the first embodiment, damages caused by repeated elastic deformation are reduced. The assistant member 111 thus has an improved durability.

Figure 17:
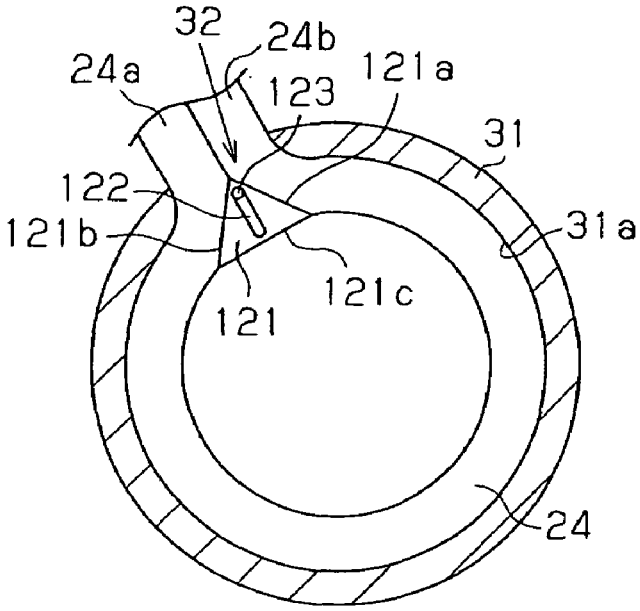
FIG. 17 is a partially cross-sectional plan view showing the configuration of a main portion of an inkjet recording apparatus according to a third embodiment of the present invention.
Figure 18:
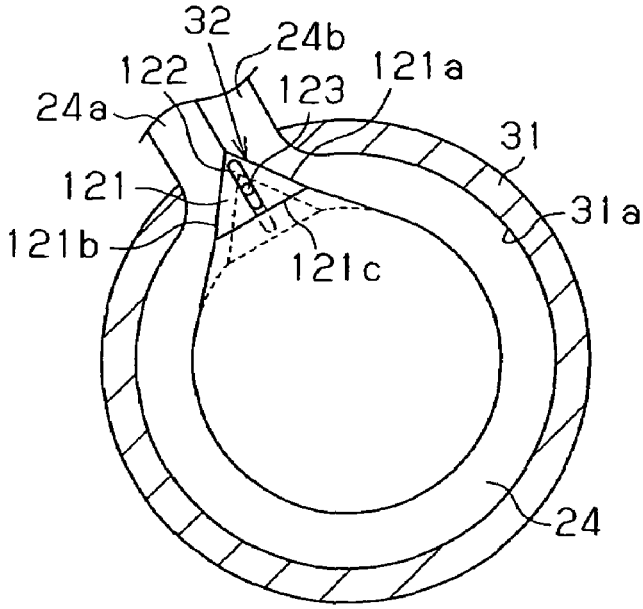
FIG. 18 is a partially cross-sectional plan view explaining the operation of the configuration of FIG. 17.

FIGS. 17 and 18 show an example of an inkjet recording apparatus, a third embodiment of a liquid ejection apparatus including a tube pump according to the present invention.

As shown in FIG. 17, the accommodating case 31, which is a constituent of the tube pump 25 of the head cleaning device 21 of the inkjet recording apparatus 10, includes an assistant member 121, in place of the assistant member 111 of the second embodiment.

Like the assistant member 111, the assistant member 121 is shaped as a substantially triangular pole with the axial dimension equal to that of the inner wall 31*a* of the case 31. The assistant member 121 is formed from an elastic material with hardness sufficient for suppressing major elastic deformation.

In the substantially same manner as the assistant member 111 of the second embodiment, the assistant member 121 includes a triangular shape that extends along the inward portions of the outer circumferential surface of the tube 24 passing through the opening 32 in the case 31. The assistant member 121 includes two slanted sides 121*a*, 121*b* and a base surface 121*c*, which is located between the slanted sides 121*a*, 121*b*.

More specifically, the slanted sides 121*a*, 121*b* of the assistant member 121 are formed as flat surfaces. The base surface 121*c* of the assistant member 121 is formed as a flat surface substantially parallel with the extended plane 35 extended from the inner wall 31*a* at the position corresponding to the opening 32. The base surface 121*c* serves as an assistant surface connected smoothly with the inward portions of the outer circumferential surface of the tube 24 passed through the opening 32 in the case 31. The slanted sides 121*a*, 121*b* may be formed as curved surfaces as in the case of the first embodiment. However, the slanted sides 121*a*, 121*b* are formed as the flat surfaces for ensuring sufficient strength for sliding of the assistant member 121, as will be described later. The tube pump 25 including the assistant member 121 may be assembled in the same manner as the first and second embodiments.

The assistant member 121 has a slide groove 122 extending vertically from the vicinity of the point between the slanted sides 121*a*, 121*b* to the vicinity of the base surface 121*c*. A slide shaft 123 is located inward from the position corresponding to the opening 32 of the case 31. The slide shaft 123 is received in the slide groove 122. More specifically, the assistant member 121 maintains the base surface 121*c* in a state substantially parallel with the extended plane 35 extended from the inner wall 31*a* at the position corresponding to the opening 32 of the case 31. In this state, the assistant member 121 is capable of sliding together with the slanted sides 121*a*, 121*b* and the base surface 121*c* selectively toward or from the opening 32 of the case 31. In the third embodiment, only the case in which the assistant member 121 slides linearly will be explained. However, like the assistant member 111 of the second embodiment, the assistant member 121 may be pivotally supported.

Thus, when the tube pump 25 is operated in accordance with the positive revolution (the cleaning operation of the head cleaning device 21) and the roller 44 is located in the vicinity of the opening 32 of the case 31, the roller 44 contacts and slides the assistant member 121 toward the opening 32, as indicated by the solid lines in FIG. 18. The roller 44 then proceeds to the base surface 121*c* connected smoothly with the outer circumferential surface of the downstream portion 24*b*. Afterwards, as moving further in the direction away from the opening 32 of the case 31, the roller 44 is transferred from the base surface 121*c* of the assistant member 121, which is held at a position close to the opening 32, to the outer circumferential surface of the upstream portion 24*a* connected smoothly with the base surface 121*c*.

In other words, as slid by the roller 44, the slanted sides 121*a*, 121*b* of the assistant member 121 press the tube 24 pressed by the roller 44 against the inner wall 31*a* of the case 31, with respect to the portions of the inner wall 31*a* corresponding to opposite sides of the opening 32. In this state, the assistant member 121 allows the roller 44 to be transferred to the base surface 121*c*.

When the roller 44 moves along the base surface 121*c* further in the direction away from the opening 32 of the case 31, the assistant member 121 returns the roller 44 to the upstream portion 24*a*, while pressing the tube 24 between the slanted sides 121*a*, 121*b* and the portions of the inner wall 31*a* corresponding to the opposite sides of the opening 32.

Therefore, when the roller 44 passes the vicinity of the opening 32 of the case 31, the tube 24 is maintained in a pressed state, thus preventing the negative pressure in the tube 24 from being released.

At this stage, like the first and second embodiments, the roller 44 is transferred to the opposed position of the tube 24 via the base surface 121*c* of the assistant member 121. This suppresses the impact between the roller 44 and the outer circumferential surface of the tube 24 to which the roller 44 is transferred, which impact would otherwise be caused by the varied surface condition of the outer circumferential surface of the tube 24 along which the roller 44 is moving. Further, after the roller 44 returns to the outer circumferential surface of the upstream portion 24*a*, the assistant member 121 receives the recovering resilient force of the tube 24 from both of the upstream portion 24*a* and the downstream portion 24*b*. The assistant member 121 is thus retreated to a position spaced from the opening 32 and suspends the pressing of the tube 24.

In this manner, the tube pump 25 prevents the negative pressure in the tube 24 between the recording head 16 and the discharged ink reservoir 26 from being released. Also, the tube pump 25 repeatedly revolves the roller 44 silently, such that the negative pressure in the tube 24 is gradually accumulated. This structure ensures a smooth cleaning operation of the head cleaning device 21.

As has been described, the third embodiment has the same operational effects as those of the first and second embodiments. The tube pump 25 is thus capable of performing the cleaning operation of the inkjet recording apparatus 10 efficiently and silently. In addition, the assistant member 121 is relatively hard, as compared to the assistant member 101 of the first embodiment, and thus has an improved durability. Further, when the roller 44 passes the vicinity of the opening 32 of the case 31, the assistant member 121 reliably maintains the pressed state of the tube 24. The negative pressure in the tube 24 is thus accumulated, and the cleaning operation of the head cleaning device 21 is completed smoothly.

Figure 19:
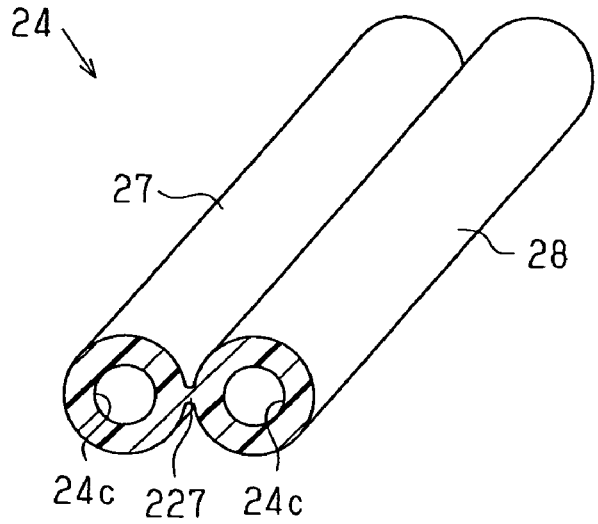
FIG. 19 is a perspective cross-sectional view showing a tube.

FIGS. 19 to 24 show an example of an inkjet recording apparatus according to a fourth embodiment of the present invention, a liquid ejection apparatus including a tube pump. As shown in FIG. 19, a flexible tube 24 includes two tube members 27, 28 formed of flexible material such as silicone rubber. The tube members 27, 28 are connected together at a connecting portion 227.

Figure 20:
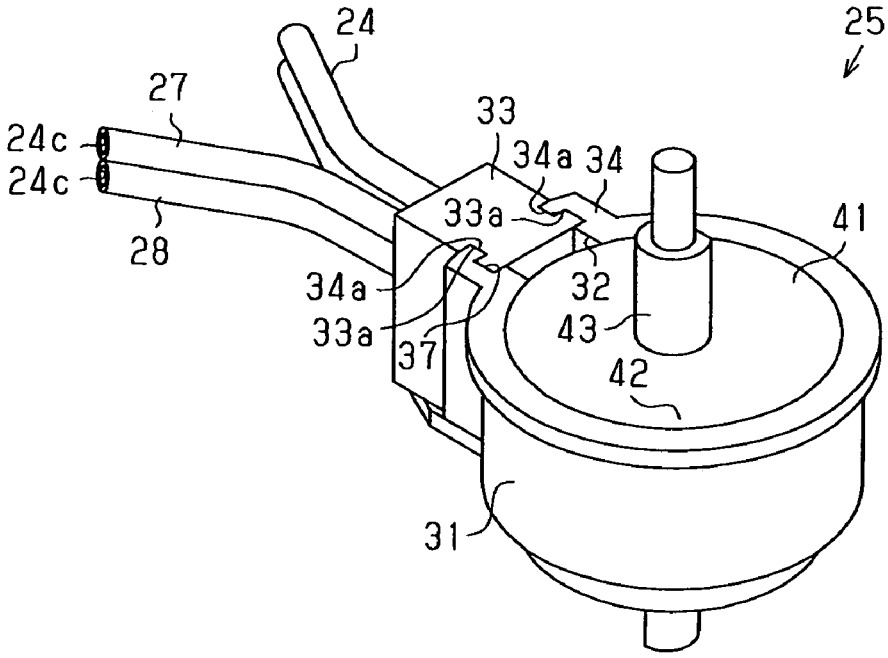
FIG. 20 is a perspective view showing the structure of a main portion of an inkjet recording apparatus according to a fourth embodiment of the present invention.

With reference to FIG. 20, a tube pump 25 includes an accommodating case 31, a fixing block 33 functioning as a fastening portion, and a pressing device 41. An opening 32, or a cutaway portion, is defined in an inner wall 31*a*, or the inner circumferential surface of the accommodating case 31. The opening 32 is defined by removing a section of the inner wall 31*a* from an upper position to a lower position in the vicinity of a bottom 31*b*.

Figure 21:
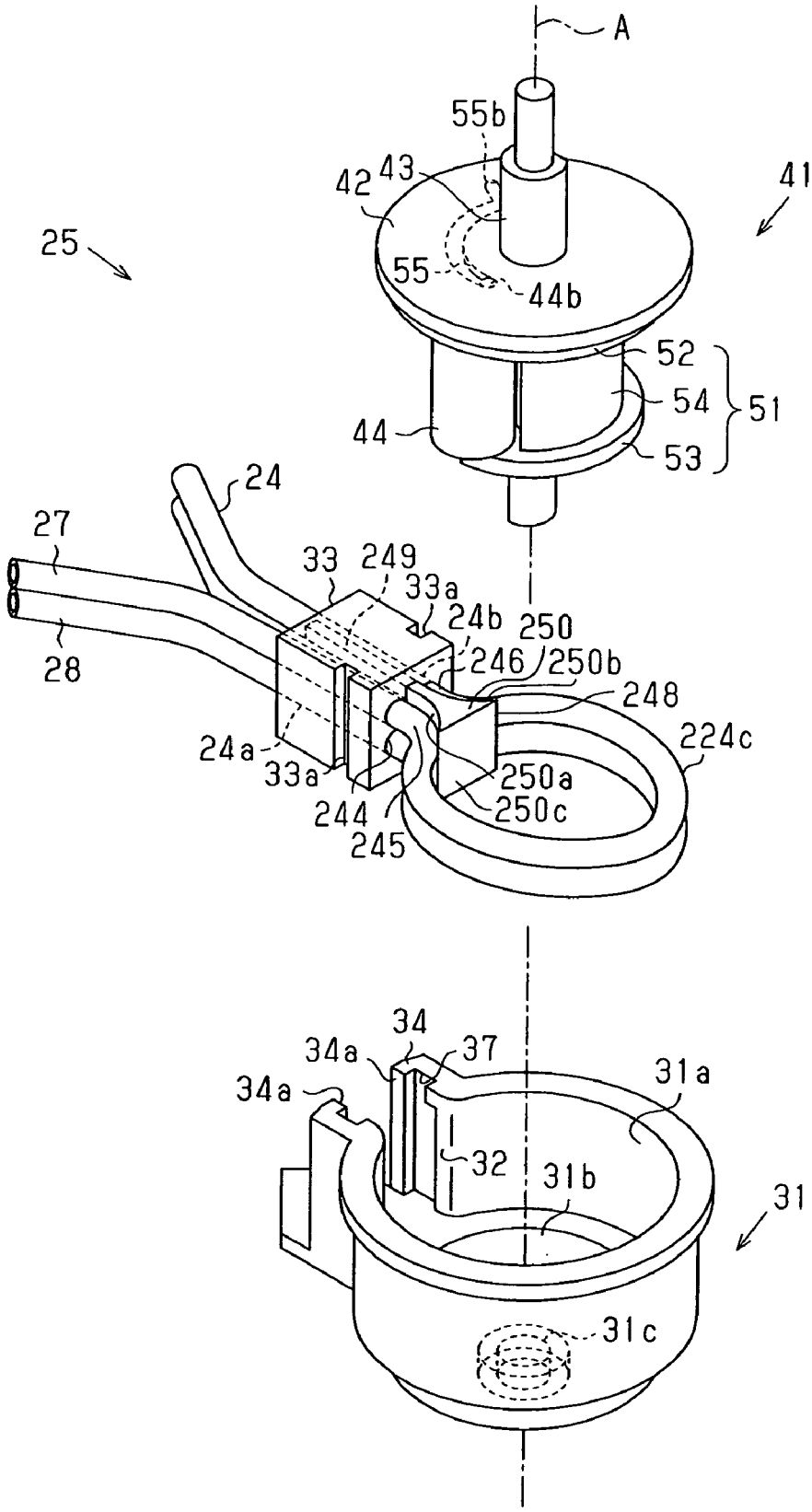
FIG. 21 is an exploded perspective view showing the structure of a main portion of the apparatus of FIG. 20.

As illustrated in FIG. 20, the fixing block 33 is received by an attaching portion 34 for defining an outlet portion. Referring to FIG. 21, the fixing block 33 includes an insertion bore 244 extending in a radial direction of the accommodating case 31. The insertion bore 244 receives the flexible tube 24 such that the tube members 27, 28 are stacked together in a vertical direction. With a portion of the flexible tube 24 received in the insertion bore 244, a pressed tube portion 224*c* is formed in the tube 24.

The pressed tube portion 224*c* is accommodated in the accommodating case 31. The pressed tube portion 224*c* is arranged along the inner wall 31*a* in such a manner to define an Ω shape, as viewed along a horizontal direction. The pressed tube portion 224*c* is exposed from the opening 32 to the exterior of the accommodating case 31, through bent tube portions 245, 246 bent along the wall of the opening 32. The first portion of the flexible tube 24 includes the bent tube portion 245. The second portion of the tube 24 includes the bent tube portion 246.

When the ink or the like (air bubble) in the cap 22 is drawn into the flexible tube 24, the drawn substance is sent from the upstream portion 24*a* to the interior of the accommodating case 31 through the bent tube portion 245. In the accommodating case 31, the substance flows in the pressed tube portion 224*c* while moving along the inner wall 31*a*. The substance then moves from the bent tube portion 246 to the exterior of the tube pump 25 through the downstream portion 24*b*. The substance is thus discharged into the discharged ink reservoir 26.

As shown in FIG. 21, a damper member 248 functioning as an assistant member is arranged between the upstream portion 24*a* and the downstream portion 24*b*. The damper member 248 is formed of highly deformable elastic material and includes a clamped portion 249 and a damper portion 250.

Referring to FIG. 21, the clamped portion 249 is located in the insertion bore 244 of the fixing block 33. The clamped portion 249 is formed in a plate-like shape having a height slightly greater than the vertical dimension (the height) of the flexible tube 24. The clamped portion 249 is arranged between the upstream portion 24*a* and the downstream portion 24*b*, which are positioned by the fixing block 33. The upstream portion 24*a* and the downstream portion 24*b* thus securely clamp the clamped portion 249. Through such clamping, the damper member 248 (the damper portion 250) is positioned with respect to the accommodating case 31.

As shown in FIG. 21, the damper portion 250 is extended from the clamped portion 249 in an enlarged manner in a radial inward direction of the accommodating case 31. The damper portion 250 is formed in a substantially triangular shape having a height equal to that of the clamped portion 249. The damper portion 250 includes a contact surface 250*a* facing the bent tube portion 245 and a contact surface 250*b* facing the bent tube portion 246. Through contact between the contact surfaces 250*a*, 250*b* and the corresponding bent tube portions 245, 246, a portion of the pressed tube portion 224*c* in the vicinity of the opening 32 is arranged along the inner wall 31*a*.

As illustrated in FIG. 21, the damper portion 250 includes an assistant surface 250*c* functioning as a pressed surface, which is formed between the contact surfaces 250*a*, 250*b*. The assistant surface 250*c* is faced in an opposite direction to the fixing block 33 and located radially inward in the accommodating case 31 as compared to the bent tube portions 245, 246. The assistant surface 250*c* is formed as a flat surface extending from the contact surfaces 250*a*, 250*b*. The assistant surface 250*c* is opposed to the extended plane 35 (see FIG. 5) extended from the inner wall 31*a* facing the fixing block 33.

In the accommodating case 31, the space defined by the pressed tube portion 224*c* accommodates the pressing device 41 such that the pressing device 41 covers the pressed tube portion 224*c* from above.

Figure 22:
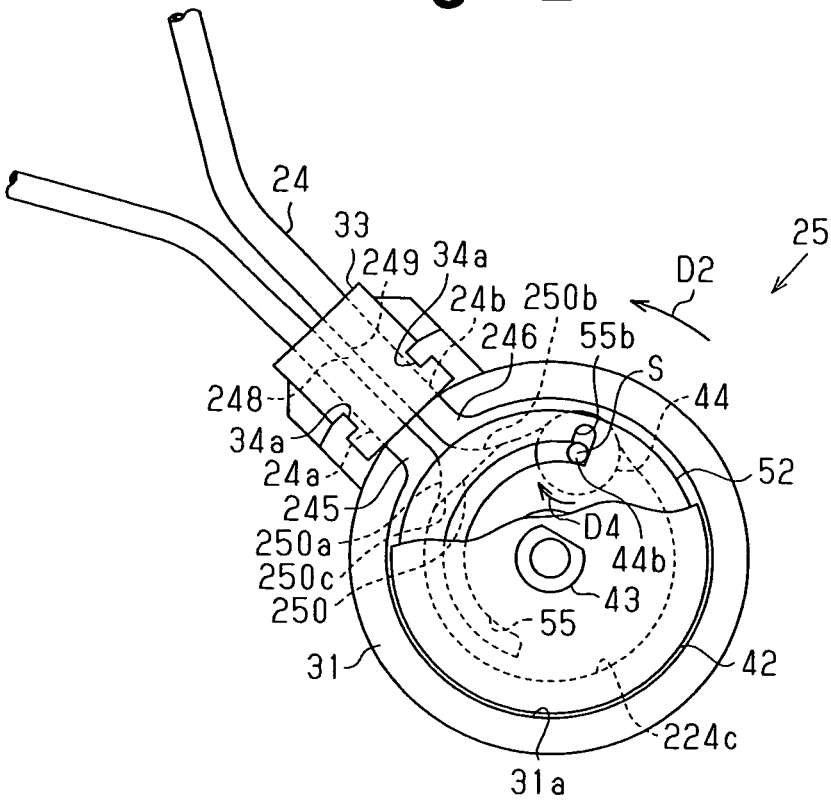
FIG. 22 is a partially cut-away plan view explaining the operation of the structure of FIG. 20.
Figure 23:
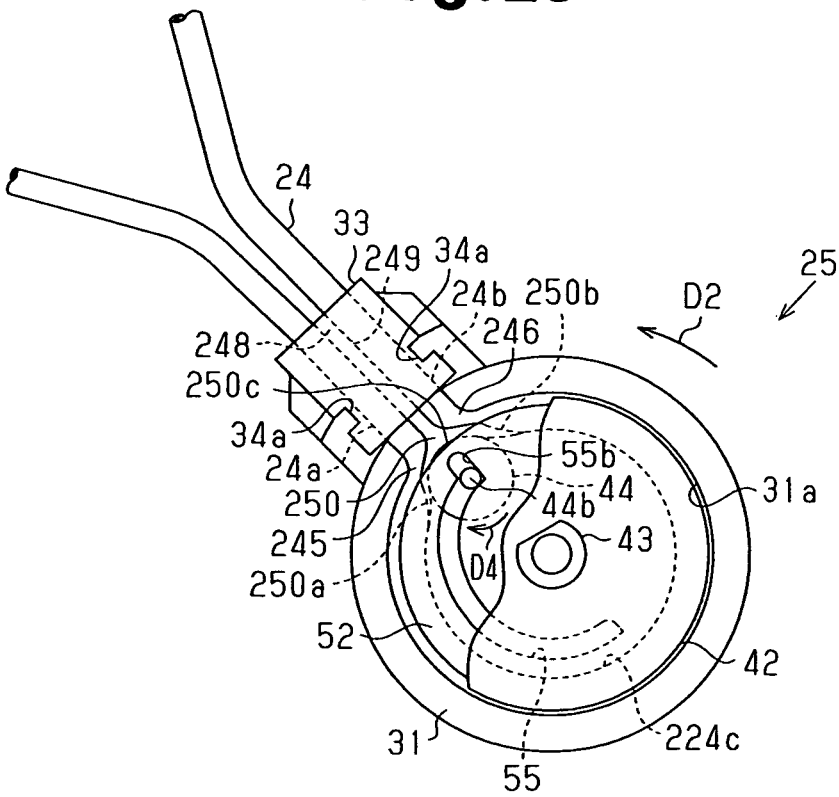
FIG. 23 is a partially cut-away plan view explaining the operation of the structure of FIG. 20.
Figure 24:
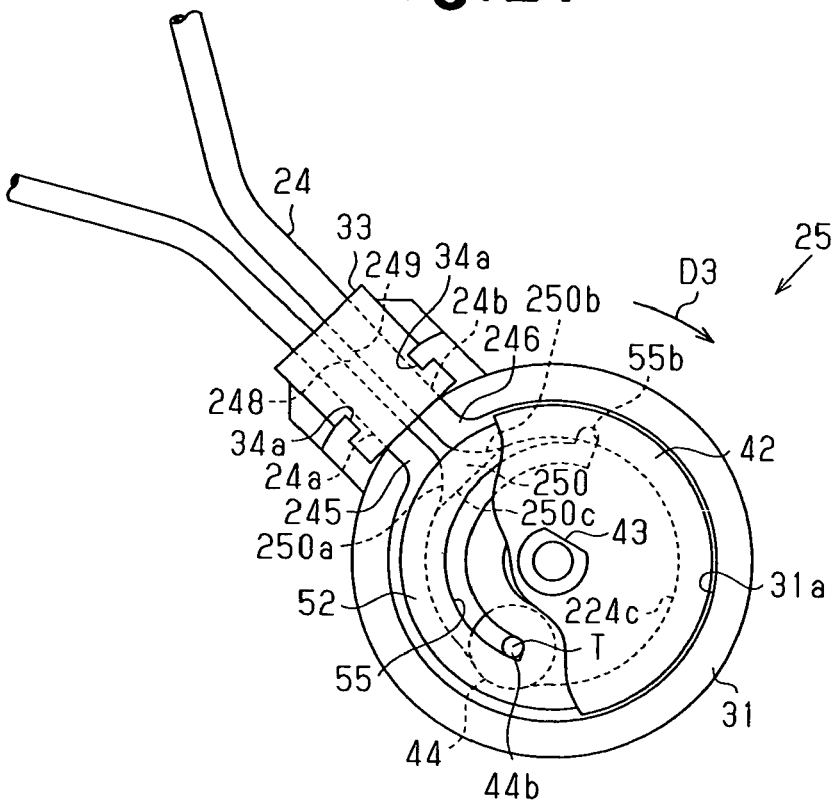
FIG. 24 is a partially cut-away plan view explaining the operation of the structure of FIG. 20.

Next, the operation of the tube pump 25, which is constructed as above-described, will be explained with reference to FIGS. 22 to 24. FIG. 22 is a plan view showing the tube pump 25 in a state in which a roller 44 serving as a pressing roller is located at a downstream position of the pressed tube portion 224*c*. FIG. 23 is a plan view showing the tube pump 25 in a state in which the roller 44 faces the assistant surface 250*c* of the damper member 248. FIG. 24 is a plan view showing the tube pump 25 in a state in which the roller 44 is revolved in an opposite direction D3 to the revolving direction D2 of FIGS. 22 and 23.

If the rotary shaft 43 is rotated in a positive direction D2, as illustrated in FIG. 22, the roller 44, which is located in the upstream portion 24*a*, receives the rotational drive force and is revolved along the inner wall 31*a* toward the downstream portion 42*b*, while squeezing the pressed tube portion 224*c*. In this manner, the roller 44 urges the ink or the like in the passage 24*c* to flow toward the downstream portion 24*b*.

After passing the downstream portion 24*b* of the flexible tube 24, which is the downstream portion of the pressed tube portion 224*c*, the roller 44 is received by the damper portion 250 (the assistant surface 250*c*). Since the assistant surface 250*c* is opposed to the extended plane 35 extended from the inner wall 31*a*, the roller 44 moves smoothly from the pressed tube portion 224*c* (the downstream portion 24*b*) to the assistant surface 250*c*. During such movement, the roller 44 presses the assistant surface 250*c* in a radial outward direction of the accommodating case 31, thus elastically deforming the damper portion 250, referring to FIG. 23. In this manner, the contact surface 250*b* squeezes the bent tube portion 246 and then the contact surface 250*a* squeezes the bent tube portion 245. In other words, after moving smoothly to the assistant surface 250*c*, the roller 44 is revolved while constantly squeezing a portion of the pressed tube portion 224*c* through the contact surfaces 250*a*, 250*b*.

After passing the assistant surface 250*c*, the roller 44 reaches the upstream portion 24*a*. More specifically, as in the movement from the downstream portion 24*b* to the assistant surface 250*c*, the roller 44 moves smoothly from the assistant surface 250*c* to the upstream portion 24*a*. When the roller 44 reaches the upstream portion 24*a*, the damper portion 250 is released from the elastic deformation.

That is, when the roller 44 is moved from the downstream portion 24*b* to the upstream portion 24*a*, the assistant surface 250*c* (the damper portion 250) passes the roller 44 smoothly from the downstream portion 24*b* to the upstream portion 24*a*. Since the clamped portion 249 is clamped between the upstream portion 24*a* and the downstream portion 24*b*, the roller 44 is allowed to move smoothly along the damper portion 250 in a constant manner, without displacing the damper portion 250 to an offset position. Also, since the roller 44 presses the contact surfaces 250*a*, 250*b* (the damper portion 250), the contact surfaces 250*a*, 250*b* are allowed to constantly squeeze a portion of the pressed tube portion 224*c*.

In this manner, the tube pump 25 prevents the roller 44 from hitting the pressed tube portion 224*c* (the bent tube portion 245). Further, intermittent squeezing of the pressed tube portion 224*c*, or intermittent drawing of the ink or the like, is avoided, such that the substance is drawn into or discharged from the pressed tube portion 224*c* in a stable manner.

The fourth embodiment has the following advantages.

(1) In the fourth embodiment, the clamped portion 249 of the damper member 248 is securely clamped between the upstream portion 24*a* and the downstream portion 24*b*. The damper portion 250 of the damper member 248 includes the contact surface 250*a* for contacting the bent tube portion 245 and the contact surface 250*b* for contacting the bent tube portion 246. The assistant surface 250*c* is formed between the contact surfaces 250*a*, 250*b* from the contact surfaces 250*a*, 250*b* and located radially inward as compared to the bent tube portions 245, 246 (The assistant surface 250*c* is opposed to the contact surfaces 250*a*, 250*b*). Thus, when the roller 44 moves from the downstream portion of the pressed tube portion 224*c* (from the downstream portion 24*b* of the flexible tube 24) to the upstream portion of the pressed tube portion 224*c* (to the upstream portion 24*a* of the tube 24), the assistant surface 250*c* guides the roller 44 and the damper portion 250 is elastically deformed. This prevents the roller 44 from hitting the bent tube portions 245, 246, thus enabling the roller 44 to move smoothly from the downstream portion 24*b* to the upstream portion 24*a*. Further, since the roller 44 squeezes the bent tube portions 245, 246 through the contact surfaces 250*a*, 250*b* of the damper portion 250, intermittent ink drawing or discharging is avoided when the roller 44 is passed from the downstream portion 24*b* to the upstream portion 24*a*.

(2) In the fourth embodiment, the assistant surface 250*c* is opposed to the extended plane 35 extended from the inner wall 31*a* opposed to the fixing block 33. The roller 44 is thus allowed to move further smoothly when moving from the downstream portion 24*b* to the assistant surface 250*c* or from the assistant surface 250*c* to the upstream portion 24*a*. Accordingly, vibration or noise production caused by hitting between the roller 44 and the bent tube portions 245, 246 are further effectively reduced.

(3) In the fourth embodiment, when the drawing and discharging of the ink or the like is completed, the rotary shaft 43 of the tube pump 25 is revolved in a negative direction D3 such that the roller 44 is retracted to a retreat position T. Thus, when the tube pump 25 does not perform cleaning operation of the nozzle forming surface 16*a*, the pressed tube portion 224*c* and the damper portion 250 are released from squeezing by the roller 44. As a result, the pressed tube portion 224*c* and the damper portion 250 are prevented from becoming deteriorated due to the squeezing of the roller 44.

(4) In the fourth embodiment, the clamped portion 249, which is extended from the damper portion 250, is securely clamped between the upstream portion 24*a* and the downstream portion 24*b*, which are positioned by the fixing block 33. The damper member 248 is thus reliably maintained and positioned with respect to the accommodating case 31 by means of a relatively simple structure.

Figure 25:
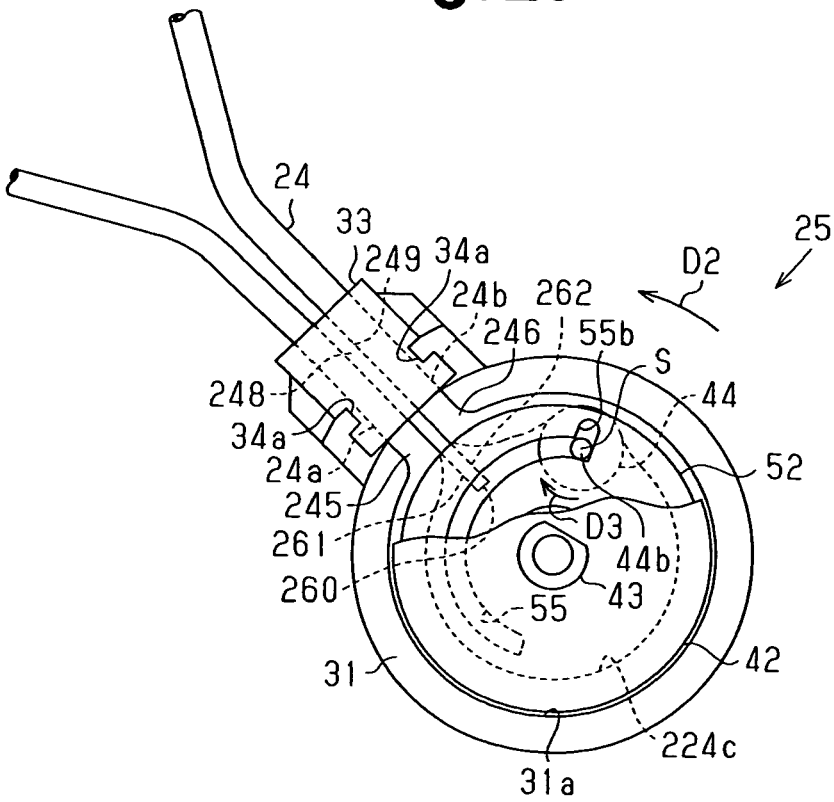
FIG. 25 is a partially cut-away plan view showing the structure of an inkjet recording apparatus according to a fifth embodiment of the present invention.
Figure 26:
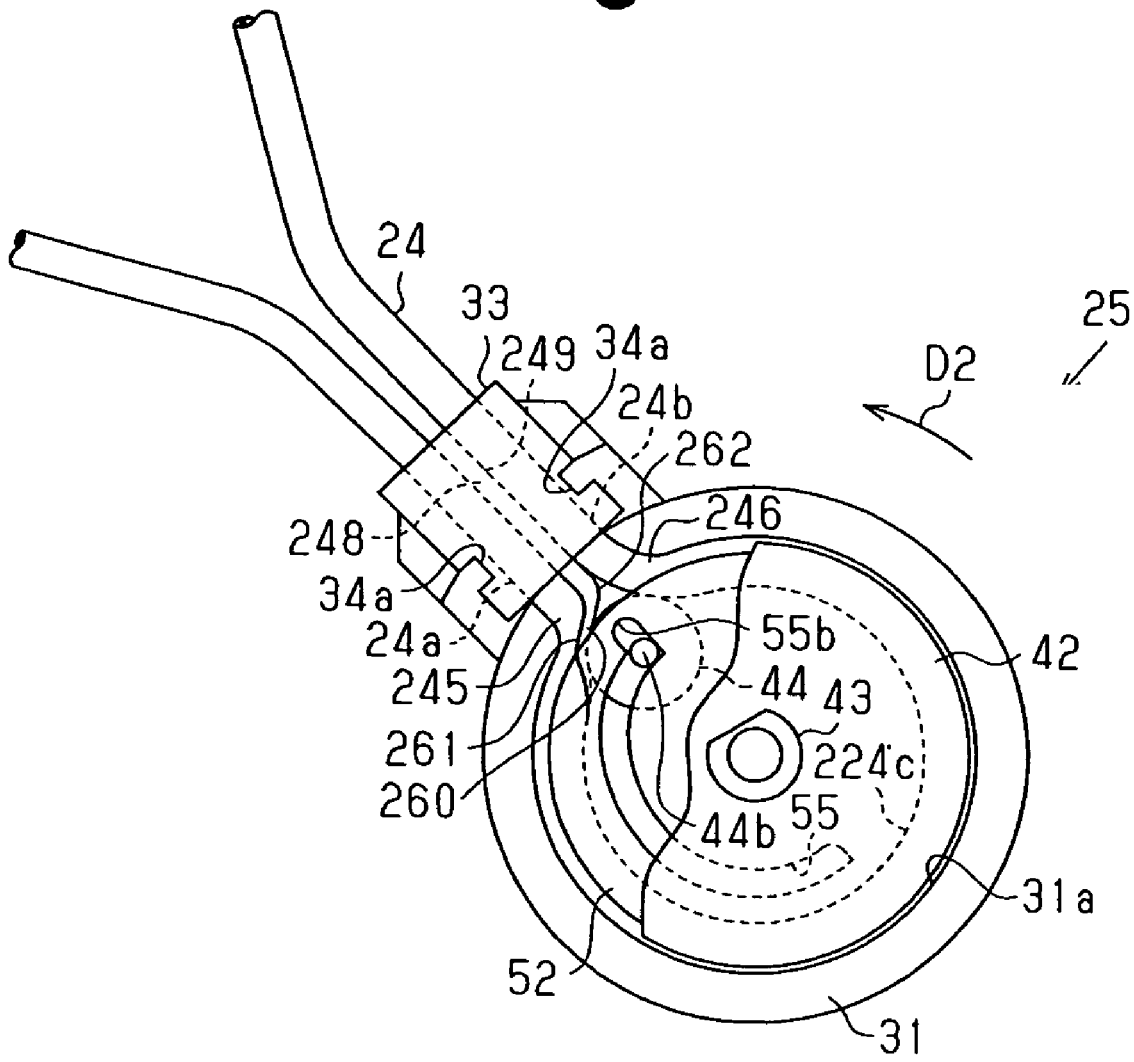
FIG. 26 is a partially cut-away plan view explaining the operation of the structure of FIG. 25.
Figure 27:
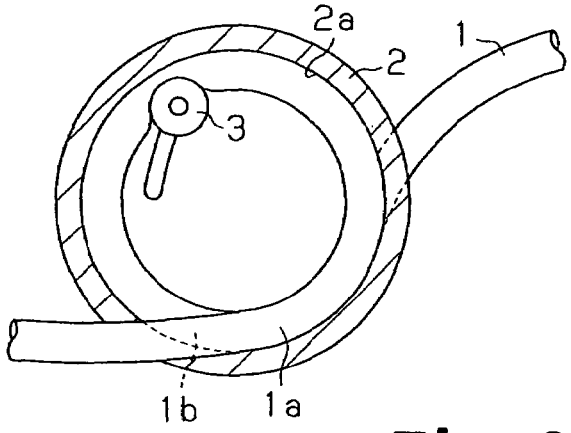
Fig.27 (Prior Art)
FIG. 27 is a cross-sectional plan view showing a portion of a prior art technique.
Figure 28:
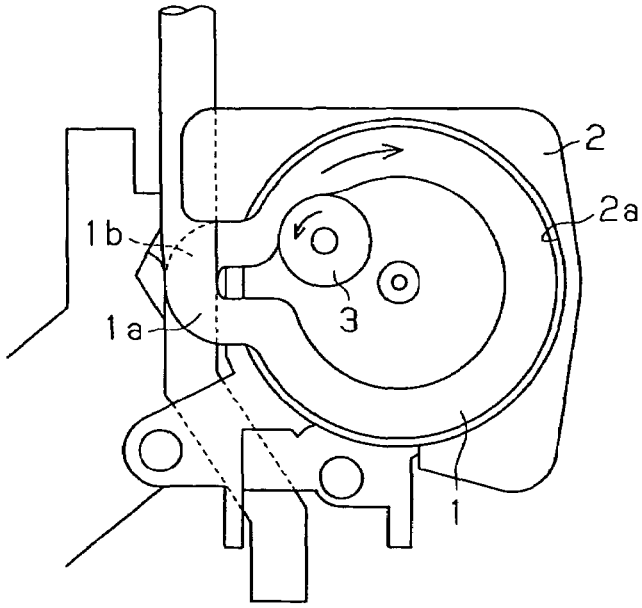
Fig.28 (Prior Art)
FIG. 28 is a plan view showing another prior art technique.
Figure 29:
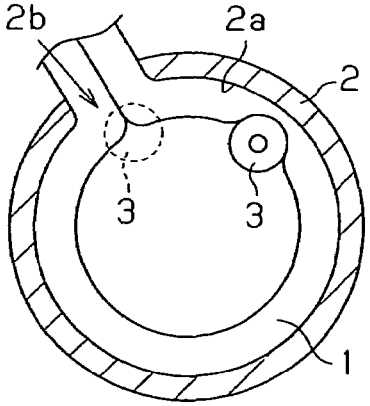
Fig.29 (Prior Art)
FIG. 29 is a cross-sectional plan view showing a portion of an improved version of the technique of FIG. 28.

A fifth embodiment of the present invention will hereafter be explained with reference to FIGS. 25 and 26. In the fifth embodiment, the shape of the damper portion 250 of the tube pump 25 according to the fourth embodiment is modified. The remaining structure of the fifth embodiment is identical to that of the fourth embodiment. The following description thus focuses on the modification from the fourth embodiment. FIG. 25 is a cross sectional plan view showing the tube pump 25 in a state in which the roller 44 is located in the downstream portion 24*b*. FIG. 26 is a cross-sectional plan view showing the tube pump 25 in a state in which the roller 44 is located at a position opposed to the fixing block 33.

As shown in FIG. 25, the damper member 248 includes a plate-like damper portion 260 shaped substantially identical to that of the clamped portion 249. The damper portion 260 is formed of highly deformable elastic material. The damper portion 260 is formed integrally with the clamped portion 249 and extends in a radial inward direction of the accommodating case 31. The damper portion 260 includes a contact surface 261 and a pressing surface 262. The contact surface 261 is formed by a flat side surface of the damper portion 260 facing the bent tube portion 245. The pressing surface 262 is formed by a flat side surface of the damper portion 260 facing the bent tube portion 246. The contact surface 261 functions as an assistant surface. The damper portion 260 is accommodated in the space defined between the bent tube portions 245, 246, such that such space is divided into an upstream side and a downstream side of a pressed tube portion 224*c*.

If the pump motor is driven and the rotary shaft 43 is rotated in the positive direction D2, the roller 44, which is located in the upstream portion 24*a*, is revolved along the positive direction D2 toward the downstream portion 24*b*, while squeezing the pressed tube portion 224*c*, referring to FIG. 25. After passing the downstream portion 24*b*, the roller 44 moves along a portion of the inner wall 31*a* corresponding to the opening 32 while squeezing the bent tube portion 246, thus contacting the pressing surface 262 of the damper portion 260.

Correspondingly, the damper portion 260 (the pressing surface 262) is bent by the pressing force acting in the positive direction D2 of the roller 44. The contact surface 261 is thus brought into contact with the bent tube portion 245. Therefore, as shown in FIG. 26, the roller 44 is revolved along the damper portion 260 (the pressing surface 262) while pressing the damper portion 260, thus squeezing the bent tube portion 245. In other words, when the bent tube portions 245, 246 are squeezed, the damper portion 260 enables the roller 44 to move smoothly from the downstream portion 24*b* to the upstream portion 24*a*.

Accordingly, the roller 44 moves smoothly from the downstream portion 24*b* to the upstream portion 24*a* of the flexible tube 24, while constantly squeezing a portion of the downstream portion 24*b* or the upstream portion 24*a* (a portion of the pressed tube portion 224*c*). When the roller 44 reaches the upstream portion 24*a*, the damper portion 260 is released from the bent state. Since the clamped portion 249 is clamped between the upstream portion 24*a* and the downstream portion 24*b*, the roller 44 moves smoothly along the damper portion 260 in the bent state, without displacing the damper portion 260 to an offset position.

The fifth embodiment has the following advantages.

(1) In the fifth embodiment, the damper portion 260, which is formed of elastic material, has a plate-like shape that is substantially identical to that of the clamped portion 249. The damper portion 260 extends in a radial inward direction of the accommodating case 31. When moving from the downstream portion 24*b* to the upstream portion 24*a*, the roller 44 squeezes the bent tube portion 245 through the damper portion 260. The roller 44 is thus prevented from hitting the bent tube portion 245, such that the roller 44 is passed smoothly from the downstream portion 24*b* to the upstream portion 24*a*. Further, since the roller 44 squeezes the bent tube portion 245 through the damper portion 260 when moving from the downstream portion 24*b* to the upstream portion 24*a*, intermittent ink drawing or discharging is avoided by the tube pump 25. Also, since the damper portion 260 and the clamped portion 249 have the substantially identical plate-like shapes, the damper member 248 is relatively easy to machine or mass-produce, as compared to the case in which curved surfaces must be formed through complicated machining.

(2) In the fifth embodiment, the clamped portion 249 of the damper member 248 is securely clamped between the upstream portion 24*a* and the downstream portion 24*b*, which are positioned by the fixing block 33. In this manner, the damper member 248 is reliably positioned and maintained with respect to the accommodating case 31 by means of a relatively simple structure.

The illustrated embodiments may be modified in the following forms.

In the illustrated embodiments, the contact surfaces 250*a*, 250*b* are formed as curved surfaces. However, these surfaces may be formed as flat surfaces. As long as the contact surfaces 250*a*, 250*b* and the assistant surface 250*c* are capable of allowing the roller 44 to move smoothly and squeeze the bent tube portions 245, 246 through pressing, such surfaces may have any suitable shapes.

Although the tube pump 25 has the single roller 44 in the illustrated embodiments, the tube pump 25 may include a plurality of rollers 44.

In the illustrated embodiments, the damper member 248 includes the clamped portion 249 and the damper portion 250 that are formed as one body. However, the clamped portion 249 and the damper portion 250 may be provided separately. That is, as long as the damper portion 250 is positioned by the clamped portion 249, any suitable configuration may be employed.

In the illustrated embodiments, the support 51 (the coil spring 61) urges the roller 44 in a radial outward direction of the accommodating case 31. However, as long as the roller 44 is allowed to squeeze the pressed tube portion 224*a* or the damper portion 250, 260 even when free from urging by the support 51, the coil spring 61 may be omitted.

In the illustrated embodiments, the clamped portion 249 is accommodated in the space defined by the fixing block 33. However, the clamped portion 249 may be projected from such space in a radial outward direction of the accommodating case 31. Further, as long as the clamped portion 249 is securely clamped between the upstream portion 24*a* and the downstream portion 24*b*, the clamped portion 249 may be projected into the space defined by the fixing block 33 through the opening 32 by only a restricted projecting amount.

The accommodating case 31 does not necessarily have to be circular but may be oval or have other shapes, as long as the case 31 is provided with smoothly connected inner wall surfaces. Also, the case 31 does not necessarily have to have a single opening 32, through which the tube 24 is passed, but may have two or more openings 32.

Although the examples of an inkjet recording apparatus having a liquid ejection apparatus have been explained in the illustrated embodiments, the present invention is not restrictive to the embodiments. The present invention may be employed in, for example, an ejection apparatus for electrode materials or coloring materials, which is used in the manufacture of liquid crystal or EL displays.

As is clear to those skilled in the art, the present examples and embodiments are to be considered as illustrative and not restrictive and the invention is not to be limited to the details given herein, but may be modified within the scope and equivalence of the appended claims, without departing from the scope of the present invention.

The invention claimed is:

1. A tube pump comprising:

a flexible tube in which a fluid passage is formed;

an accommodating case for accommodating the flexible tube, the tube extending along an inner wall of the case, the inner wall having an opening, the tube extending to the exterior of the case through the opening, the tube having a first portion and a second portion, which are located close to each other in the vicinity of the opening;

a pressing member revolving in the accommodating case, the pressing member moving from the first portion to the second portion along the flexible tube while pressing and squeezing a portion of the tube against the inner wall of the case, thereby enabling a fluid to flow from the first portion to the second portion in the fluid passage; and an assistant member provided in the vicinity of the opening of the accommodating case, the assistant member having an assistant surface, the assistant member transferring the pressing member from the second portion to the first portion via the assistant surface when the pressing member passes the vicinity of the opening of the case, wherein the assistant member is clamped by the first portion and the second portion, wherein a holding member is detachably installed in the opening for holding the first and second portions and the assistant member, wherein when the holding member is detached from the accommodating case, the holding member keeps holding the first portion, the second portion and the assistant member, and wherein the assistant member is detachable from the accommodating case.

2. A tube pump comprising:

a flexible tube in which a fluid passage is formed;

a cylindrical accommodating case for accommodating the flexible tube, the tube extending along an inner wall of the case;

an outlet portion for introducing the flexible tube in the accommodating case to the exterior, the tube having a first portion and a second portion located adjacent to each other in the vicinity of the outlet portion, the first and second portions being bent from a portion of the flexible tube extending along an inner wall of the accommodating case in a radial outward direction of the inner wall;

a pressing roller revolving in the accommodating case, the pressing roller moving from the first portion to the second portion along the flexible tube while pressing and squeezing a portion of the flexible tube against the inner wall of the accommodating case, thereby enabling a fluid to flow from the first portion to the second portion in the fluid passage; and a damper member arranged between the first portion and the second portion, the damper member being clamped by the first and second portions, the damper member being detachable from the accommodating case, wherein, when the pressing roller moves in the vicinity of the outlet portion, the damper member is displaced for squeezing the flexible tube and passes the roller from the second portion to the first portion; and a holding member detachably installed in the outlet portion for holding the first and second portions and the damper member, the holding member continuing to hold the first portion, the second portion and the damper member, when the holding member is detached from the accommodating case.

3. The tube pump according to claim 2, wherein the damper member is formed by a plate member projecting from the outlet portion in a radial inward direction of the accommodating case, and wherein, when the pressing roller moves in the vicinity of the outlet portion, the plate member is bent toward the inner wall of the accommodating case for squeezing the flexible tube.

4. The tube pump according to claim 2, wherein the damper member is formed of elastic material.

5. The tube pump according to claim 1, wherein the assistant member is formed from an elastic material.

6. The tube pump according to claim 5, wherein the resilient force of the assistant member is selected such that a reactive force of the flexible tube and the assistant member acting on the pressing member remains constant when the pressing member passes the vicinity of the opening.

7. The tube pump according to claim 1, wherein: the assistant member is movable toward or away from the opening; and when the pressing member contacts the assistant surface the assistant member moves toward the opening and presses at least one of the first and second portions.

8. The tube pump according to claim 1, wherein a portion of the flexible tube accommodated in the accommodating case forms an Ω shape.

9. The tube pump according to claim 1, wherein the pressing member revolves around the revolution axis, wherein the flexible tube does not have overlapped portions in the accommodating case with respect to the revolution axis.

* * * * *